US012320114B2

(12) United States Patent
Krause

(10) Patent No.: US 12,320,114 B2
(45) Date of Patent: Jun. 3, 2025

(54) METHOD OF INSTALLING AN ADJUSTABLE SUPPORT SYSTEM FOR A BUILDING STRUCTURE

(71) Applicant: Advanced Architectural Products, LLC, Allegan, MI (US)

(72) Inventor: G. Matt Krause, Allegan, MI (US)

( * ) Notice: Subject to any disclaimer, the term of this patent is extended or adjusted under 35 U.S.C. 154(b) by 449 days.

(21) Appl. No.: 17/697,743

(22) Filed: Mar. 17, 2022

(65) Prior Publication Data

US 2022/0298779 A1 Sep. 22, 2022

Related U.S. Application Data

(60) Provisional application No. 63/162,288, filed on Mar. 17, 2021.

(51) Int. Cl.
*E04B 1/38* (2006.01)

(52) U.S. Cl.
CPC ..... *E04B 1/388* (2023.08); *E04B 2001/389* (2023.08)

(58) Field of Classification Search
CPC ..... E04B 1/388; E04B 1/38; E04B 2011/389; E04B 2011/405; E04B 2002/025; E04B 2002/7462; E04F 13/08; E04F 13/23; E04F 13/0801; E04F 13/083; E04F 13/0817
USPC ..... 248/200
See application file for complete search history.

(56) References Cited

U.S. PATENT DOCUMENTS 441,492 A * 11/1890 Kelley ..... E04G 21/1808 33/410
1,004,194 A * 9/1911 Platt ..... E04G 21/1808 33/406
1,060,284 A * 4/1913 Platt ..... E04G 1/1808 33/410
2,788,579 A * 4/1957 Mills ..... E04G 21/1808 33/406
4,144,649 A * 3/1979 Huston ..... E04G 21/1816 33/409
4,970,797 A * 11/1990 Sarasin ..... E04G 21/1808 33/494
4,995,167 A * 2/1991 Sanchez ..... E04G 21/1816 33/406
7,310,888 B2 * 12/2007 Gilliland ..... E04G 21/1808 33/404
8,511,041 B2 * 8/2013 Fransen ..... E04G 21/1816 33/645

(Continued)

FOREIGN PATENT DOCUMENTS

WO 2004090248 A2 10/2004

*Primary Examiner* — Nkeisha Smith
(74) *Attorney, Agent, or Firm* — The Watson IP Group, PLC; Jovan N. Jovanovic

(57) ABSTRACT

A method of installing a plurality of brackets. A bracket is provided as is a story pole. A plurality of brackets are releasably attached to the story pole. The story pole is positioned proximate an outside surface to which the plurality of brackets is to be attached. The first one of the plurality of brackets is attached to the outside surface in a desired orientation. The second, as well as any other brackets, is attached to the outside surface in a desired orientation. The story pole is released from the brackets leaving the plurality of brackets attached to the outside surface in alignment in at least one dimension.

17 Claims, 19 Drawing Sheets

(56) References Cited

U.S. PATENT DOCUMENTS

| | | | | |
|---|---|---|---|---|
| 8,826,555 | B2 * | 9/2014 | Ruonavaara | E04G 21/1816 33/408 |
| 9,493,941 | B2 * | 11/2016 | White | E04B 1/388 |
| 9,856,655 | B2 * | 1/2018 | Knight | E04F 13/0862 |
| 10,407,917 | B1 * | 9/2019 | Bilge | E04F 13/0816 |
| 11,933,053 | B2 * | 3/2024 | Jansen van Vuuren | E04B 1/388 |
| 2024/0093505 | A1 * | 3/2024 | Lopez | E04F 13/0807 |

* cited by examiner

METHOD OF INSTALLING AN ADJUSTABLE SUPPORT SYSTEM FOR A BUILDING STRUCTURE

CROSS-REFERENCE TO RELATED APPLICATION

This application claims priority from U.S. Patent App. Ser. No. 63/162,288, filed Mar. 17, 2021, entitled "Method of Installing an Adjustable Support System for a Building Structure", the entire specification of which is hereby incorporated by reference in its entirety.

This application is related to, but does not claim priority from, U.S. patent application Ser. No. 17/149,668, filed Jan. 14, 2021, entitled "Adjustable Support System For A Building Structure And A Wall Structure Having An Adjustable Support System", and also related to U.S. patent application Ser. No. 16/912,575, filed Jun. 25, 2020, entitled "Adjustable Support System For A Building Structure And A Wall Structure Having An Adjustable Support System," the entire specification of each of which is hereby incorporated by reference in their individual entirety.

BACKGROUND OF THE DISCLOSURE

1. Field of the Disclosure

The disclosure relates in general to the method of installing building structures, and more particularly, to a method of installing an adjustable support system for building walls.

2. Background Art

With the cost of energy ever increasing, addressing building thermal losses has become more and more important. In building assembly, cladding and insulation are applied to the outside of a building substrate. Thermal isolation of the cladding from the substrate has increasing been a focus due to the large thermal losses due to heat conduction between the cladding and the building substrate.

While there have been advances in thermal protection and insulation, there are typically connectors and structural members between the substrate and the cladding which have exhibit high thermal conductivity. For example, many such structures have continuous metal portions that form a path between the substrate and the cladding. Many thermal losses are attributed to this highly thermally conductive conduit.

Additionally, and somewhat separately, in many instances, the outer surface of the building substrate is uneven or has imperfections. It is desired to correct these imperfections when applying the cladding sot that the cladding is both uniform and generally free of undulations, and imperfections. Often, undulations in cladding, are unsightly, and can contribute to deterioration of the cladding which can then compromise the insulation and other structures.

As such, providing structures which have high thermal insulative properties while also correcting for imperfections, undulations and other problems associated with building substrates so that cladding can be uniformly installed is highly desirable. As such structures can be discrete in some fashion, installation of such structures may be difficult with respect to alignment so as to couple the structures together or to attach further beams or structures therebetween.

SUMMARY OF THE DISCLOSURE

The disclosure is to a method of installing an adjustable support system to an outside or inside wall. In one configuration the adjustable support system has a base bracket member, a clip member, and an outer bracket. The base bracket member has a first end wall that overlays a substrate, a body wall extending outwardly therefrom and a second end wall opposite the first end wall. The clip member has a base bracket member coupling, and a projecting arm. The base bracket member coupling is attached to the first end wall and overlies a portion of the body wall. The projecting arm is spaceable apart from the body wall. The outer bracket has a spanning wall with inner and outer sides. An outer end wall extends from the outer side.

Prior to attachment of the outer end wall, a story pole can be utilized with a plurality of assembled base brackets being removably coupled thereto. The brackets with the story pole can be lifted into position along the building and secured to the building, with the story pole insuring that the alignment is achieved between the different base brackets. The story pole can then be removed. The spanning wall is slidably positionable between the body wall of the base bracket member and the at least one clip member, to sandwich the same. And, the outer bracket can be adjusted relative to the base brackets to achieve the desired orientation of the outer bracket for securement of the cladding.

In an aspect of the disclosure, the disclosure is directed to a method of installing a plurality of brackets comprising the steps of: providing the plurality of brackets; providing a story pole, wherein the story pole has a first end and a second end; releasably attaching the plurality of brackets to the story pole; positioning the story pole having the plurality of brackets proximate an outside surface to which the plurality of brackets is to be attached; attaching a first one of the plurality of brackets to the outside surface in a desired orientation; attaching a second one of the plurality of brackets in a desired orientation; attaching at least a plurality of remaining ones of the plurality of brackets to the outside surface; and releasing the story pole from the plurality of brackets that are attached to the outside surface, leaving the plurality of brackets attached to the outside surface in alignment in at least one dimension.

In some configurations, the method further comprises the step of suspending the story pole and the remaining ones of the plurality of brackets from the first one of the plurality of brackets after the step of attaching the first one of the plurality of brackets to the outside surface.

In some configurations, the method further includes the step of moving at least one of the plurality of brackets after the step of attaching the first one of the plurality of brackets to the outside surface.

In some configurations, the method includes the step of moving at least a plurality of the plurality of brackets after the step of attaching the first one of the plurality of brackets to the outside surface.

In some configurations, the step of releasably attaching comprises the step of sandwiching the story pole between portions of at least one of the plurality of brackets and maintaining the same through a biasing force exerted between the bracket and the story pole.

In some configurations, the biasing force is such that a user can apply a moving force that overcomes the biasing force to allow for adjustment of the orientation of the at least one of the plurality of brackets upon which the biasing force is exerted, whereupon release of such moving force precludes further movement of the at least one of the plurality of brackets due at least the biasing force.

In some configurations, the at least one of the plurality of brackets is retained in a desired orientation solely by the biasing force.

In some configurations, the method further comprises the step of second releasably attaching the story pole to the first one of the plurality of brackets with a fastener.

In some configurations, the method further comprises the step of removing the fastener prior to the step of releasing.

In some configurations, the story pole further includes at least one demarcation thereon. In some such configurations, the method further includes the step of aligning at least one of the plurality of brackets based upon the at least one demarcation.

In some configurations, the method further includes the step of attaching an outer bracket to a plurality of the plurality of brackets after the step of attaching the brackets to the outside surface after the step of releasing the story pole.

In some configurations, the method further includes the step of aligning the story pole and the first one of the plurality of brackets into a desired orientation relative to the outside surface prior to the step of attaching the first one of the plurality of brackets.

In another aspect of the disclosure, the disclosure is directed to a method of installing a plurality of brackets comprising the steps of: providing the plurality of brackets; providing a story pole, wherein the story pole has a first end and a second end; releasably attaching the plurality of brackets to the story pole; positioning the story pole having the plurality of brackets proximate an outside surface to which the plurality of brackets is to be attached; attaching a first one of the plurality of brackets to the outside surface in a desired orientation; attaching a second one of the plurality of brackets in a desired orientation; and releasing the story pole from the plurality of brackets that are attached to the outside surface, leaving the plurality of brackets attached to the outside surface in alignment in at least one dimension.

In some configurations, the plurality of brackets comprises at least three brackets. In some such configurations, the method further comprises the step of attaching at least a plurality of the remaining ones of the plurality of brackets to the outside surface.

In another aspect of the disclosure, the disclosure is directed to a story pole for use in the method set forth above.

In some such configurations, a first portion has an inner edge and an outer edge, defining a first side and a second side opposite the first side. At least one of a demarcation and a level indicator is disposed thereon.

In some configurations, the story pole further includes at least one of a flange positioned at one of the outer edge and between the outer edge and the inner edge, and, an opening disposed between the first end and the second end.

In another aspect of the disclosure, the disclosure is directed to a system comprising an outer bracket, a plurality of base brackets, and a story pole. The plurality of base brackets is configured to be attachable to an outside surface. The outer bracket is attachable to the plurality of base brackets in a spaced apart configuration. The story pole is releasably attachable to the plurality of base brackets. The story pole is attachable to the base brackets for alignment with and attachment to the outer surface. The story pole is released prior to the attachment of the outer bracket to the plurality of base brackets.

In some configurations, the story pole further includes at least one of a demarcation disposed thereon and a level indicator.

In some configurations, the story pole includes a first portion having an inner edge that is interfaceable with the plurality of base brackets, and an outer edge opposite the inner edge, and further including at least one of an opening and a flange extending from the first portion between at least one of at the outer end and between the inner end and the outer end.

BRIEF DESCRIPTION OF THE DRAWINGS

The disclosure will now be described with reference to the drawings wherein.

DETAILED DESCRIPTION OF THE DISCLOSURE

Figure 1:
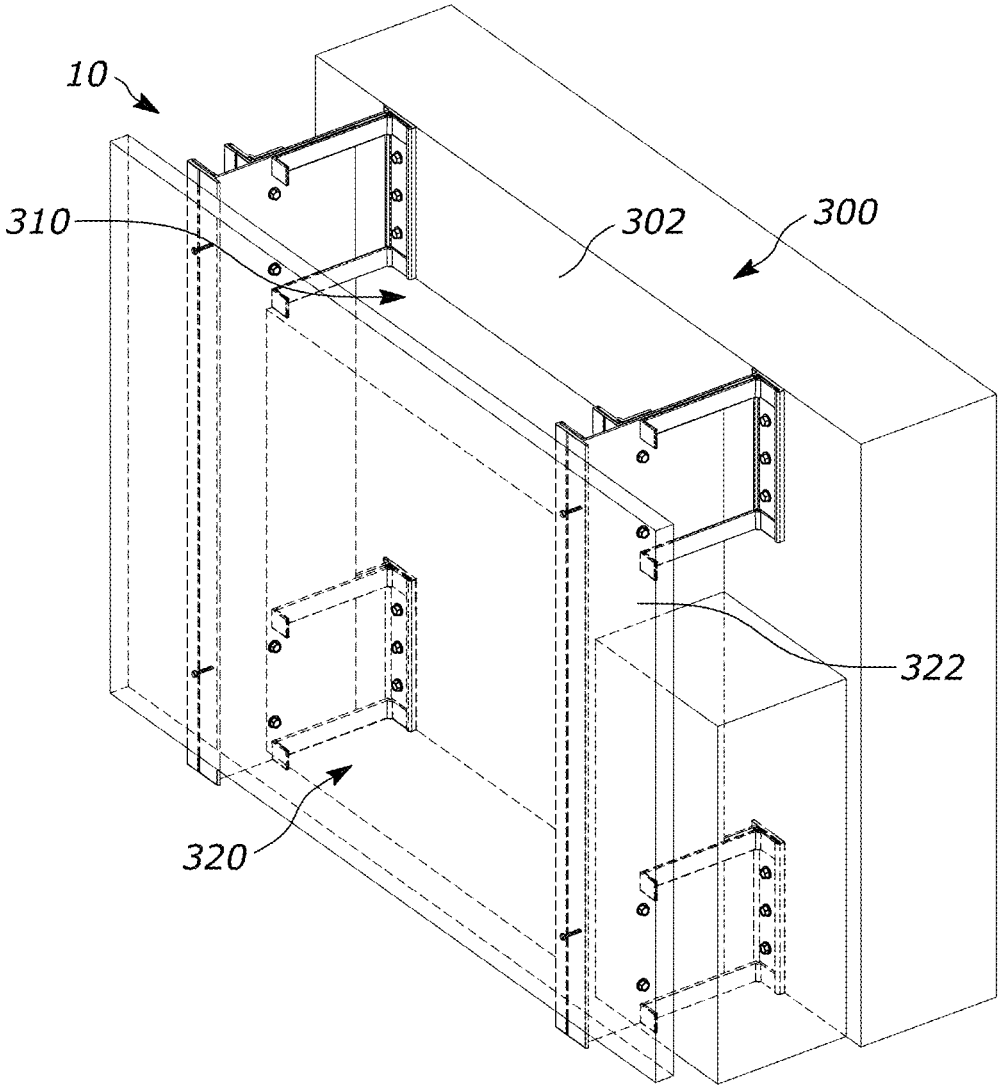
FIG. 1 of the drawings is a perspective view of a wall having the adjustable wall system of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
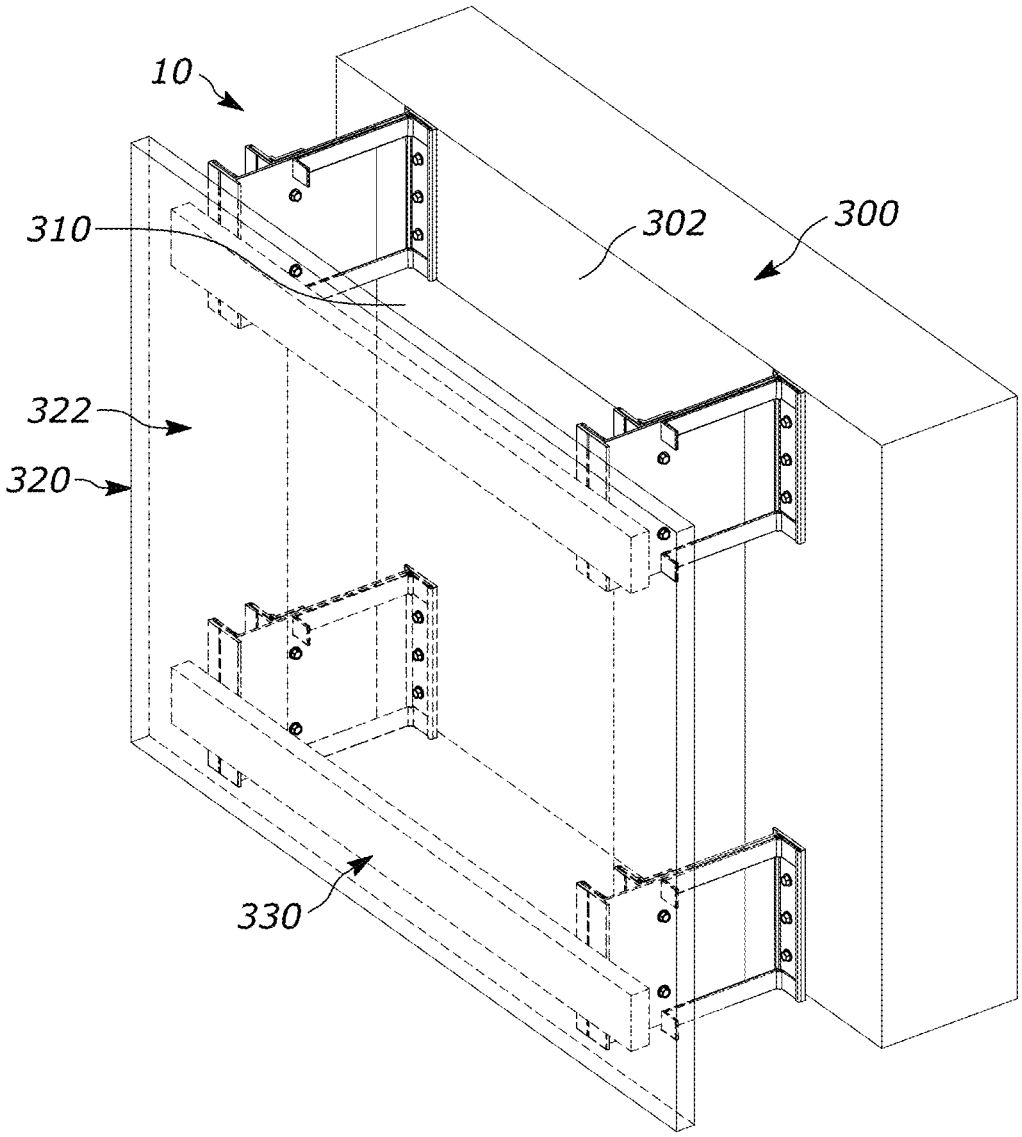
FIG. 2 of the drawings is a perspective view of a wall having the adjustable wall system of the present disclosure.

Referring now to the drawings and in particular to FIGS. 1 and 2, the adjustable support system is shown generally at 10. The adjustable support system 10 forms a structure between substrate 300 and cladding assembly 320. The substrate may comprise a wall surface which is attached to a plurality of wall studs or the like (wood, metal or composite, for example, and without limitation). Alternatively, the substrate may comprise a concrete or block wall. Of course, other substrates are likewise contemplated. The substrate includes an outer surface 302. Typically, such an outer surface may be planar, may include surface imperfections, surface variations as well as a plurality of different surfaces.

The cladding assembly 320 includes cladding sheet 322 which may be attached to the adjustable support system opposite the substrate. In some configurations, rails, such as rails 330 may extend between adjacent portions of the adjustable support system and the cladding sheet. A number of different cladding materials are contemplated for use, including, but not limited to metal sheeting (flat, corrugated or otherwise), siding, composite sheet material, fiberboard, just to name a few. The adjustable support system is not limited to any particular substrate or cladding, and the foregoing is merely exemplary.

The disclosure is directed to a method of installing the adjustable support system 10, and more particularly to a method of installing a plurality of the base bracket members in an aligned configuration. It will be understood that other systems which have discrete elements attachable to a wall may be installed in a similar manner, and that the disclosure is not limited to the installation of the particular adjustable support system members of the present disclosure, or the base brackets of the present disclosure. Indeed, the applicability of the method disclosed herein extends beyond the brackets of the present disclosure.

The adjustable support system 10 as is shown in FIGS. 3-5*a* and 7 comprises base bracket member 14, base mounting member 16, clip member 18, distal mounting member 20, outer bracket 22, distal coupling member 24, base fasteners 26 and bracket fasteners 28. The assembled base bracket member, base mounting member, clip member, and distal mounting member collectively define a base bracket system assembly.

Figure 6:
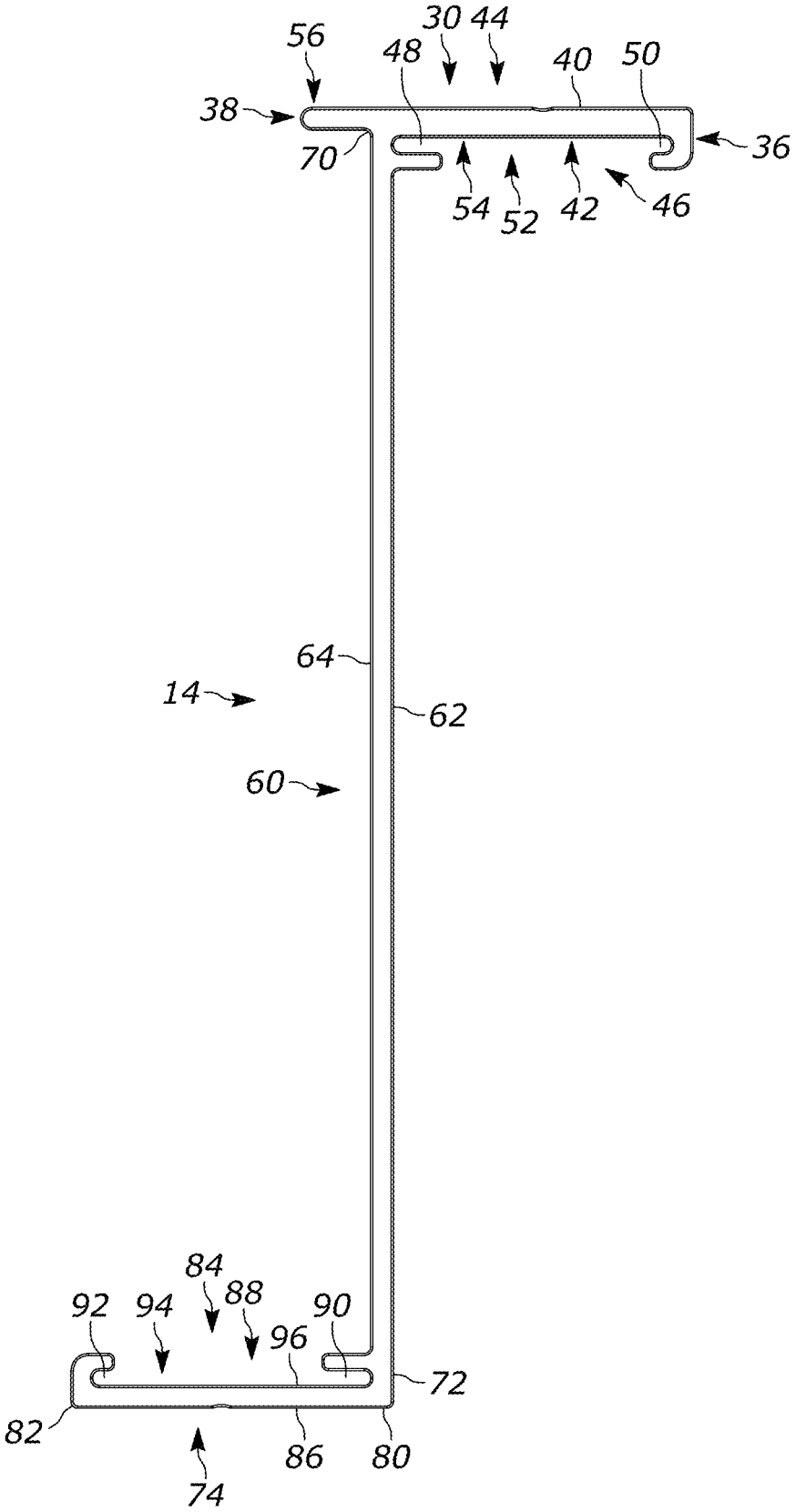
FIG. 6 of the drawings is a side elevational view of the base bracket member of the present disclosure.
Figure 7:
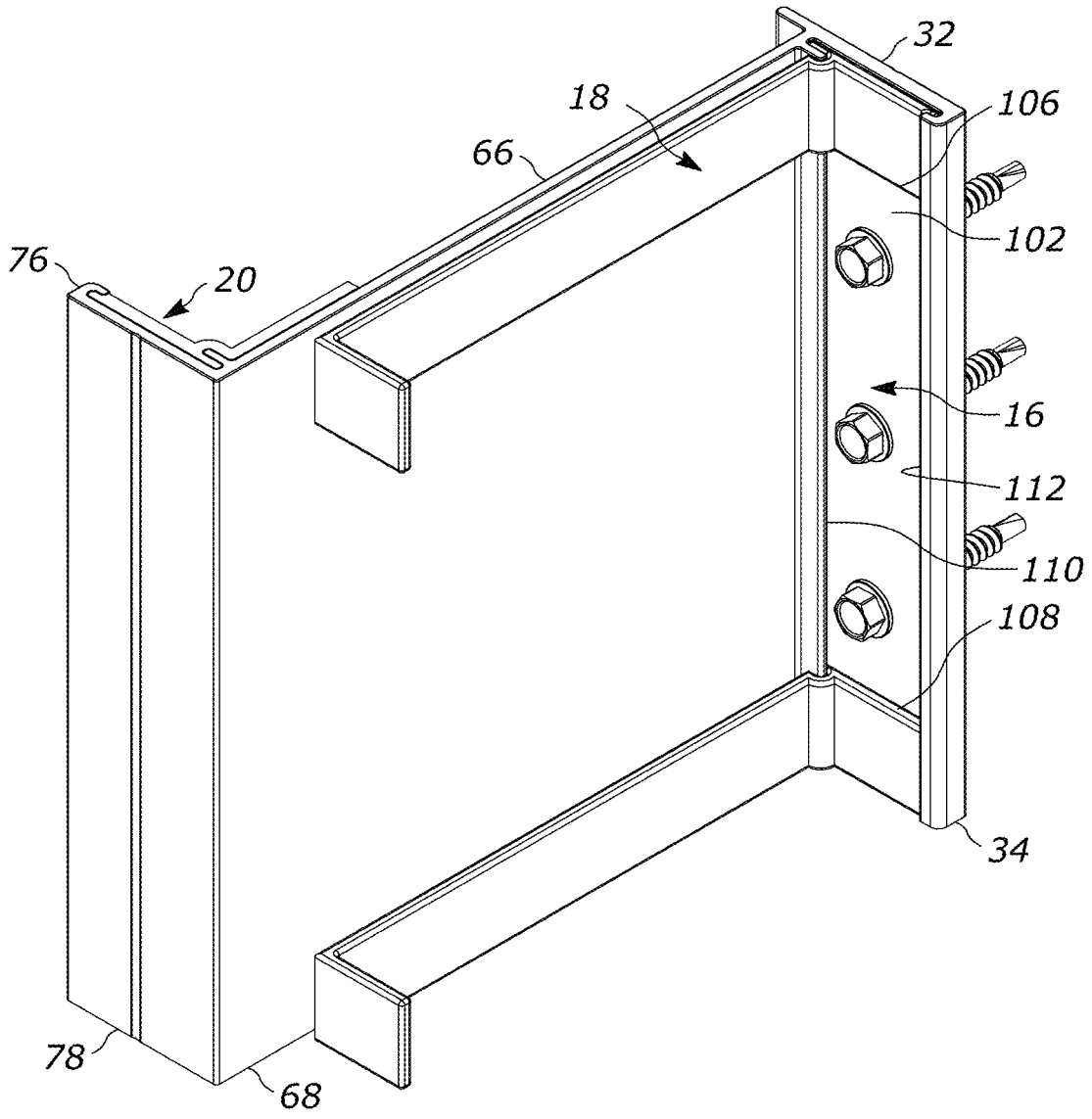
FIG. 7 of the drawings is a perspective view of the base bracket member of the present disclosure, with the base mounting member, the clip member and the distal mounting member coupled thereto.

The base bracket member 14 is shown in FIGS. 6 and 7 as comprising first end wall 30, body wall 60 and second wall 74. The base member may comprise a polymer and fiber composite based material that may be pultruded. One such configuration is disclosed in U.S. Pat. No. 8,826,620 issued to Krause, the entire specification of which is hereby incorporated by reference in its entirety. Of course, other configurations are contemplated as well, including other configurations of the present assignee, among others. It will be understood therefore, that the cross-sectional configuration of the base bracket member is substantially uniform along the length thereof, preferably, as the formation is completed by pultrusion through a pultrusion die. It will be understood that variations may be formed along the length of the base bracket member. It is additionally contemplated, and as will be explained below, a multitude of the base bracket members can be utilized in a single installation, and also to cooperate with a single outer bracket.

In the configuration shown, the first end wall 30 includes top edge 32, bottom edge 34, first side edge 36, second side edge 38. The first end wall 30 includes facing side 40 and outward side 42 opposite the facing side 40. In the configuration shown, the facing side 40 overlies the substrate. The first end wall comprises a first leg region 44 extending one direction from the body wall and a second leg region 56 extending in the opposite direction from the body wall. In the configuration shown, the width of the first leg region is larger than the width of the second leg region, while variations are contemplated. In the configuration shown, the first leg region and the second leg region define the substantially planar facing side 40.

A channel 46 is defined on the outward side 42 of the first leg region 44. The channel 46 includes first side slot 48 and a second side slot 50 opposite the first side slot, with a central opening 52 therebetween exposing the base 54 between the first side slot and the second side slot. In the configuration shown, the first side slot and the second side slot are generally mirror images of each other about a line that extends along the longitudinal axis of the channel 46. It will be understood and explained below that the channel is configured to receive the base mounting member 16 and the clip member 18 in mating engagement. It is contemplated which include tab-like features that extend into the first side slot and the second side slot. In other configurations, the first end wall 30 may include tab-like features with the base mounting member 16 and the clip member 18 comprising slot like features for mating slidable engagement. In still other configurations, the outward side 42 may comprise a planar structure, with structures adhered or otherwise coupled thereto.

The body wall 60 extends from the first end wall, and generally defines the delineation between the first leg region 44 and second leg region 56. In the configuration shown, the body wall is generally perpendicular to the first end wall and includes first side 62 and second side 64 defining a thickness. The perimeter is typically defined by the top edge 66, bottom edge 68, inner edge 70 and outer edge 72.

The second end wall 74 is positioned at the outer edge 72 of the body wall opposite the first end wall 30. The second wall is generally defined by the top edge 76, bottom edge 78, first side edge 80 and second side edge 82.

The second end wall 74 further includes an inward side 84 and a cladding side 86. The inward side generally faces toward the substrate of the building, with the cladding side facing the cladding (while variations are contemplated, and the term cladding side is not to be deemed limiting as to contact with, facing or otherwise being associated with the cladding side). In the configuration shown, the second end wall is parallel with the first end wall and perpendicular to the body wall. Variations, however, are contemplated where the walls may be oblique to each other.

The inward side 84 includes first side slot 90, second side slot 92 opposite the first side slot 90, which is spaced apart by base 96 opposite of which is central opening 94. The configuration of the inward side is much like the channel of the first leg region of the first end wall. In the configuration shown, the second end wall meets the body wall at the first side edge of the second end wall so that the second end wall terminates at the body wall. Additionally, in the configuration shown, the second end wall extends in the same direction as the second leg region of the base bracket member, and opposite of the first leg region.

The base mounting member 16 is shown in FIG. 7 as comprising elongated bar member 100 that is positioned within the channel 46 of the first end wall. Due to the configuration of the channel, the base mounting member is configured to be slidably positionable therein, and includes upper surface 102, lower surface 104, first end 106, second end 108, first slot edge 110 and second slot edge 112. In the configuration shown, the clip members 18 are likewise positioned within the channel 46 so that the length of the elongated bar member and the pair of clip members generally matches the length of the base bracket member. It will be understood that the elongated bar member may comprise a single member or multiple members that are positioned in an end to end configuration. Furthermore, it is contemplated that the elongated bar member may comprise a substantially rectangular configuration of uniform thickness. Variations are contemplated to the size and shape thereof, as will be understood by one of skill in the art. Furthermore, the elongated bar member may include a plurality of openings or may include indentations or other markings to identify appropriate regions for the extension of fasteners therethrough.

Figure 8:
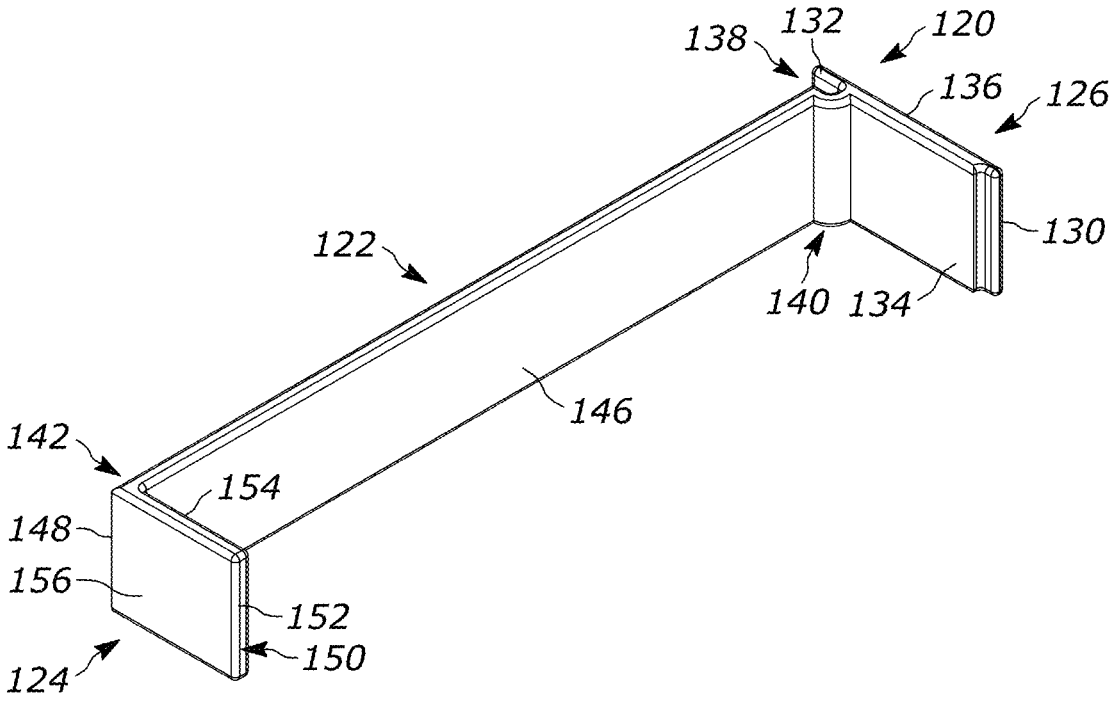
FIG. 8 of the drawings is a first side perspective view of the clip member of the present disclosure.
Figure 9:
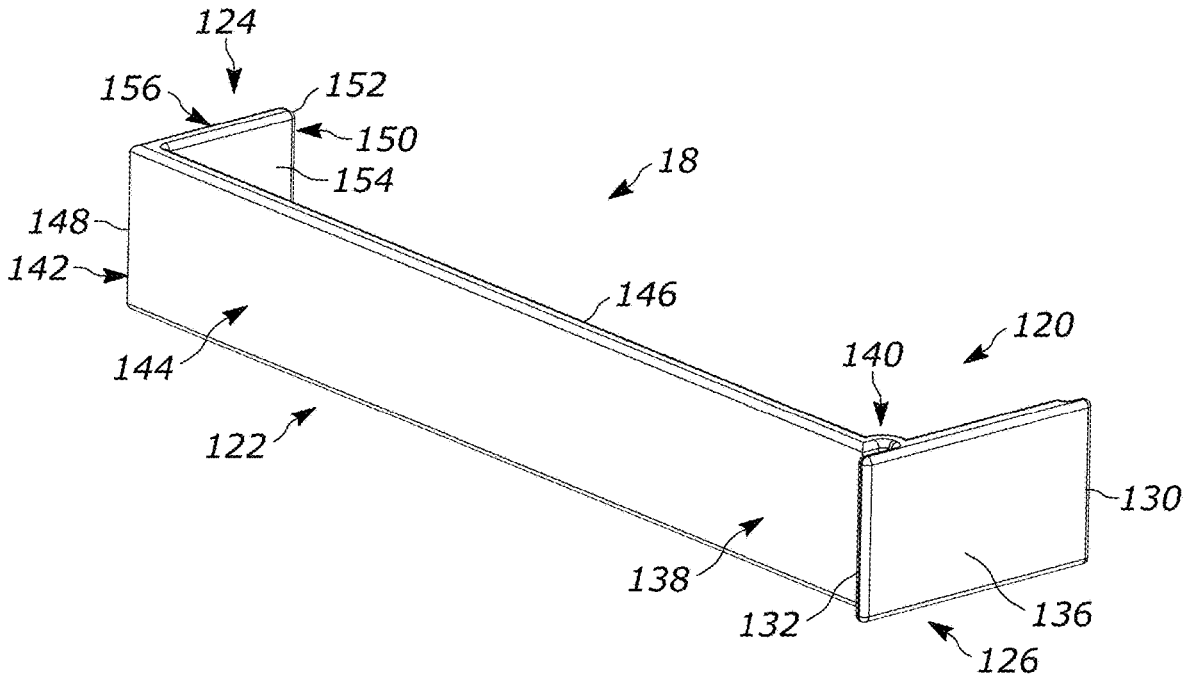
FIG. 9 of the drawings is a second side perspective view of the clip member of the present disclosure.

The clip member 18 is shown in FIGS. 8 and 9 (and assembled in FIG. 7) as comprising base bracket member coupling 120, projecting arm 122 and distal flange 124. The base bracket member coupling 120 and the distal flange are generally perpendicular to each other with the projecting arm being oblique to each or perpendicular to each. In certain configurations, the distal flange 124 and the projecting arm 122 may be perpendicular to each other with the base bracket member coupling being oblique to each so that the projecting arm is inclined toward the body wall 60 of the base bracket member when installed, so as to provide a biasing force against the distal mounting member toward the body wall of the base bracket member 14. While two clip members are shown, it is contemplated that a single clip member, or in excess of three clip members may be utilized (without limitation).

Figure 5A:
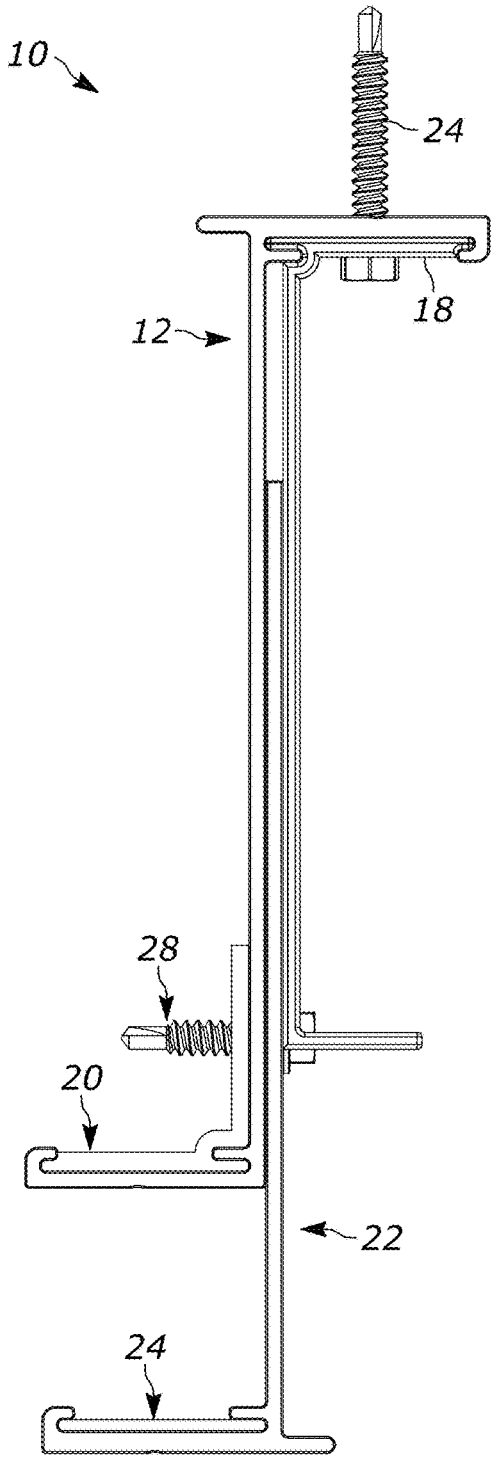
FIG. 5A of the drawings is a side elevational view of the adjustable support system of the present disclosure.
Figure 5B:
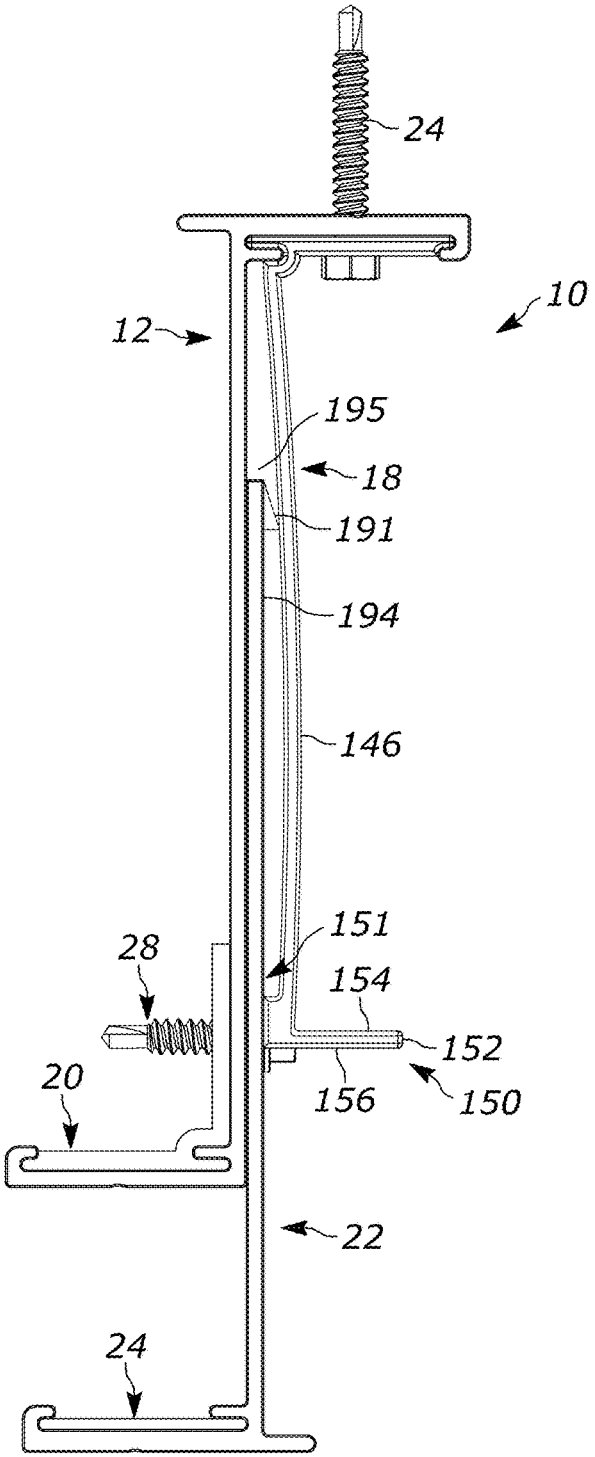
FIG. 5B of the drawings is an elevational view of an alternate configuration of the adjustable support system of the present disclosure.

In an alternate configuration, and with reference to FIG. 5B, the clip member 18 further includes an inwardly protruding stop 151 positioned at the distal end thereof which faces the outer bracket 22. At the same time, the outer bracket 22 includes an outwardly directed flange 191 that is positioned at the distal end 195 thereof. As will be understood, the inwardly protruding stop 151 precludes removal of the outer bracket from the sandwiched configuration as the protruding stop 151 catches the outwardly directed flange 191 and precludes the same from passing therebeyond. A user can pull the distal end of the clip member so as to provide sufficient clearance for the outer bracket 22 and the outwardly directed flange to move beyond the protruding stop to separate the same.

This can be helpful as inadvertent disengagement of the structures is precluded if, for example, the outer bracket 22 experiences a separating force. It will be understood that the outwardly directed flange 191 can be formed during pultrusion, or may comprise a folded over portion wherein the outer bracket 22 is formed from a metal member, such as a steel or aluminum member. In other words, the interface between the protruding stop and the outwardly directed flange precludes separation of the outer bracket from between the base bracket and the at least one clip member.

The base bracket member coupling 120 includes slot engaging member 126 which includes first slot side 130, second slot side 132, upper surface 134 and lower surface 136. As will be explained below in greater detail the slot engaging member slidably positionable and movable within the channel of the first end wall of the base bracket member.

The projecting arm 122 extends from the base bracket member coupling 120 at the proximal end 138 (coupling through the notch 140) to distal end 142, and include inner surface 144 that generally faces the body wall 60 and outer surface 146 opposes the inner surface 144. In the configuration shown, the projecting arm 122 comprises a substantially planar configuration, and of substantially uniform thickness, while variations are contemplated. In the configuration shown, the notch 140 facilitates the projecting arm 122 to be positioned closer to the body wall than would otherwise be possible due to the configuration of the first side slot 48 of the first end wall.

The distal flange 124 is shown in FIG. 1 as comprising proximal end 148, distal end 150, with an inner surface 154 and an outer surface 156 opposite the inner surface. The distal flange is generally oblique or perpendicular to the projecting arm, and substantially planar. In the configuration shown, the distal flange is of substantially uniform cross-sectional configuration. The distal flange terminates at a distal edge 152, which, as explained is positioned so as to interface with insulation or the like.

In the configuration shown, the projecting arm is longer than either one of the base bracket member coupling or the distal flange, with the distal flange being shorter than the base bracket member. As will be explained in greater detail below, the projecting arm is shorter than the width of the body wall so that the distal end of the projecting arm is spaced apart from the outer edge of the body wall. It is contemplated that the clip member may comprise a polymer and fiber composite member which is likewise pultruded. As such, the cross-sectional configuration may be substantially uniform as a result of such pultrusion, while molded polymer members are likewise contemplated. In other configurations, the member may be formed from a metal or alloy thereof through a stamping, casting or forging process.

Figure 10:
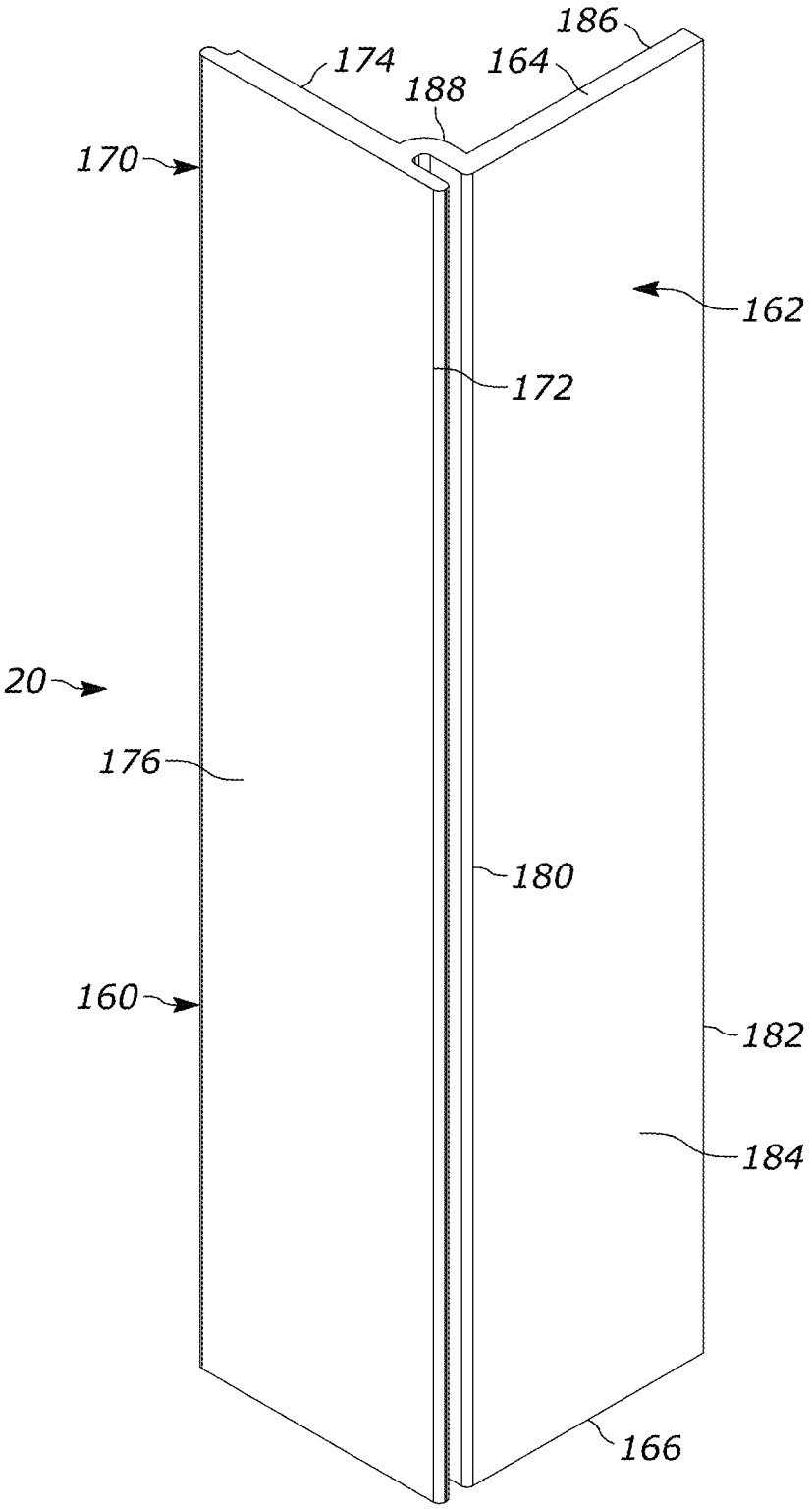
FIG. 10 of the drawings is a perspective view of the distal mounting member of the present disclosure.
Figure 11:
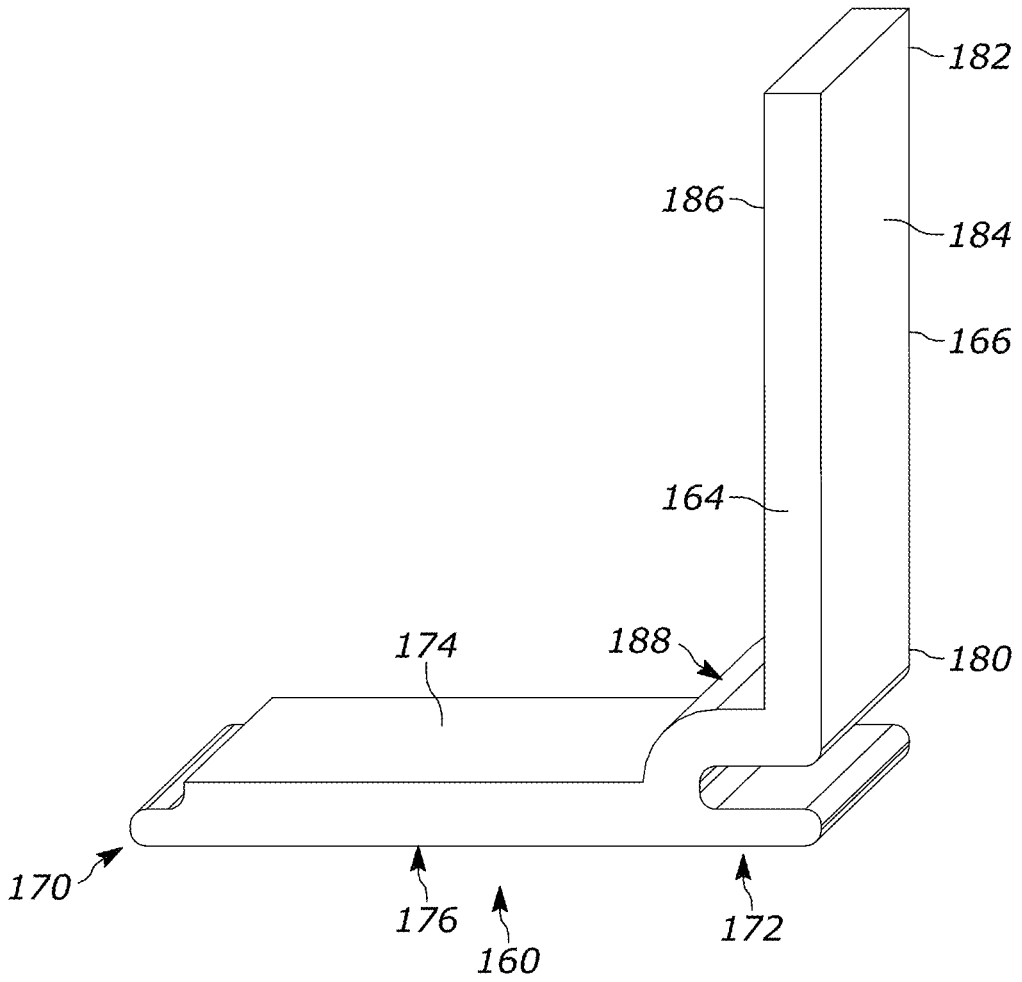
FIG. 11 of the drawings is a perspective view of the distal mounting member of the present disclosure.

The distal mounting member 20 is shown in FIGS. 10 and 11 (and in FIGS. 5*a* and 7 assembled) as comprising distal slot engaging member 160 and support arm 162. In the configuration shown, the distal mounting member comprises a substantially uniform member (which may be formed through an extrusion of a metal or alloy thereof, while not being limited thereto). The distal mounting member extends from first end 164 to second end 166. In the configuration shown, the distal mounting member has a length that generally corresponds to the base bracket member. Of course, other configurations are likewise contemplated.

The distal slot engaging member 160 of the distal mounting member includes first slot side 172, second slot side 172, upper surface 174 and lower surface 176. As will be understood and explained in greater detail below, the distal slot engaging member is slidably positionable within the channel 88 of the second end wall 74, so as to be slidably movable therewithin. The support arm 162 extends from the distal slot engaging member so as to be positioned along the second side of the body wall, and includes proximal end 180, distal end 182, inner surface 184 and outer surface 186. The proximal end includes notch 188 which facilitates the attachment of the support arm to the distal slot engaging member around the side slot of the channel. The inner surface 184 abuttingly overlies the second side 64 of the body wall 60. As will be explained, the distal mounting member provides additional stability to the fasteners 28 that couple the base bracket member to the outer bracket.

In other configurations, it will be understood that the distal slot engaging member may comprise a pair of members, one of which is positioned on the inward side of the second end wall in overlying fashion with the second end wall and a separate member which is positioned in overlying fashion over the second side of the body wall. In still other configurations, it is contemplated that the distal mounting member may comprise a single member that is adhered or otherwise placed in such an overlying configuration. In still other configurations, the distal mounting member may be molded (or pultruded, or otherwise incorporated) into the construction of the second end of the base bracket member. Similarly, the base mounting member may similarly be molded (or otherwise) into the construction of the first end of the bracket member. That is, the configuration and mating of the base mounting member and the distal mounting member may share commonality in construction (while variations and differences are likewise contemplated).

Figure 12:
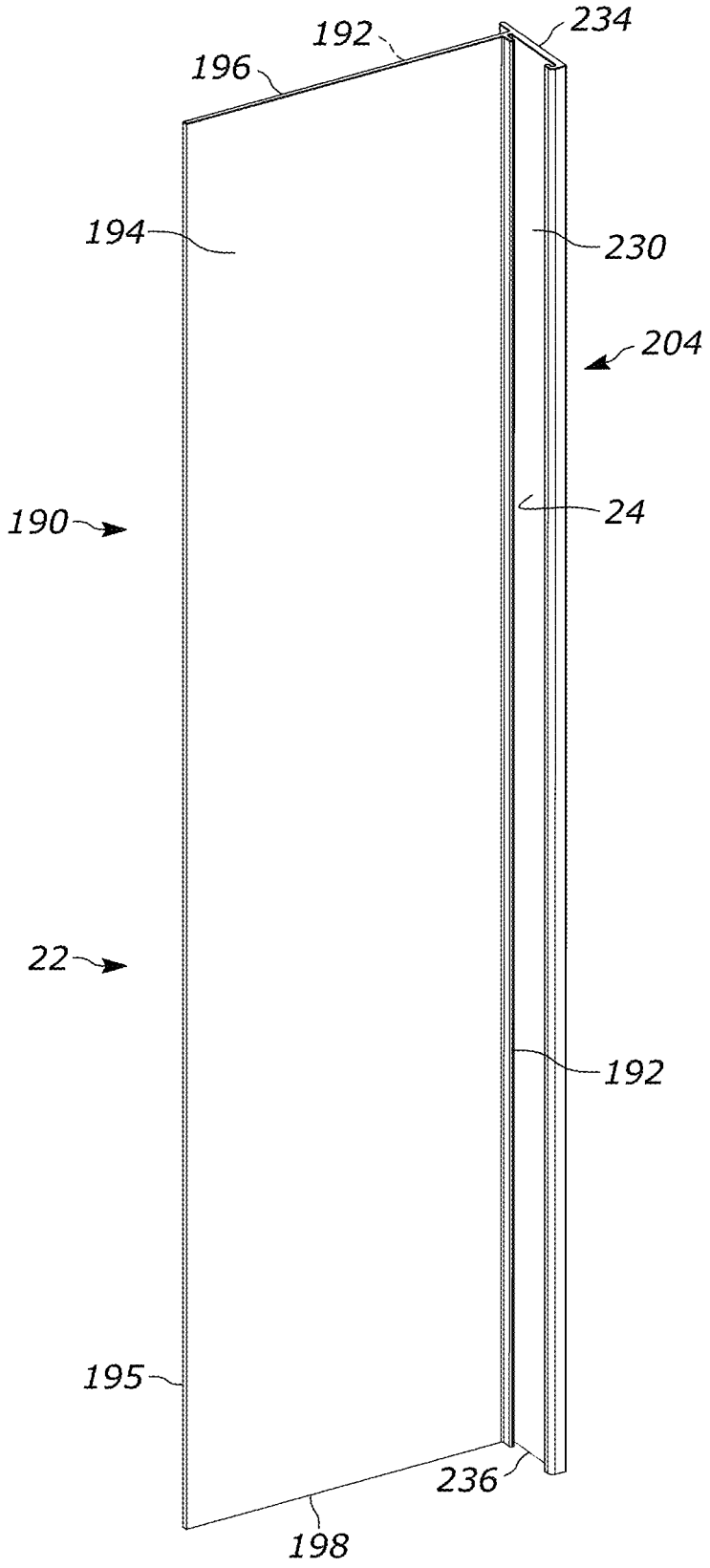
FIG. 12 of the drawings is a perspective view of the outer bracket having the distal coupling member coupled thereto.
Figure 13:
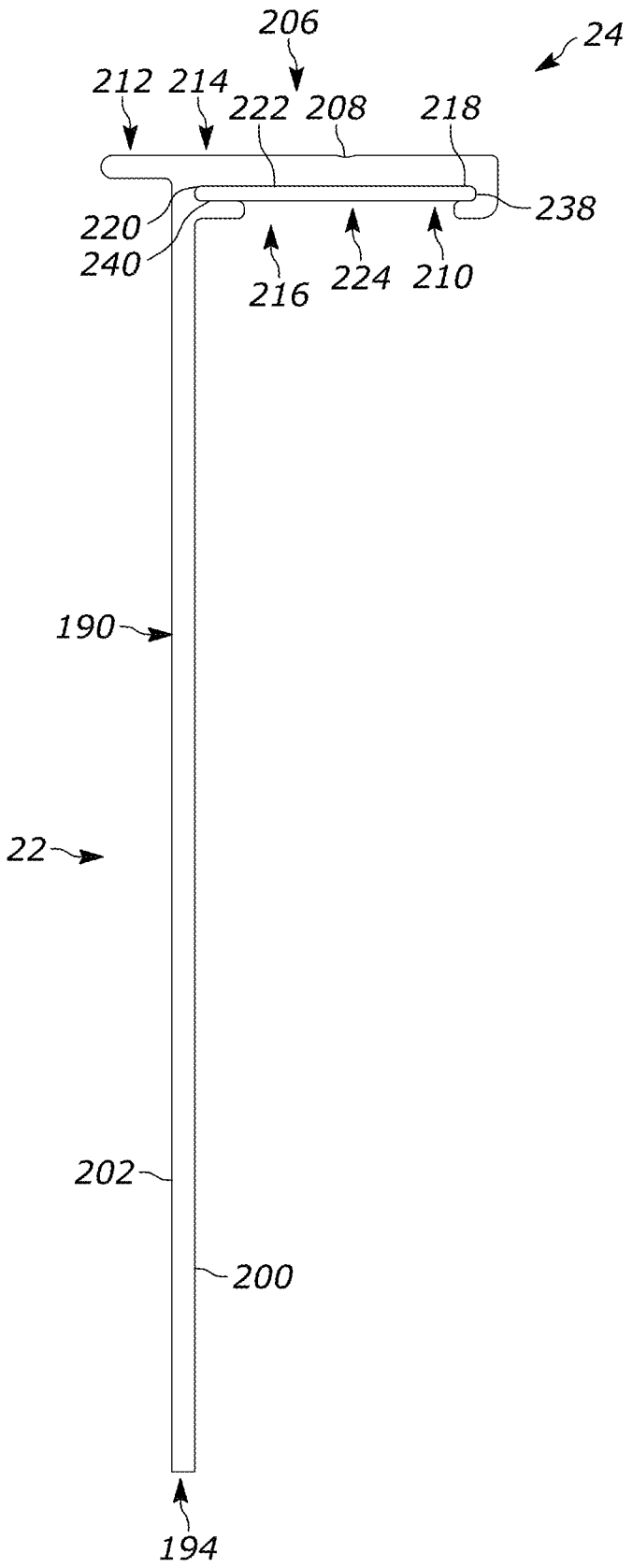
FIG. 13 of the drawings is a side elevational view of the outer bracket having the distal coupling member coupled thereto.
Figure 14:
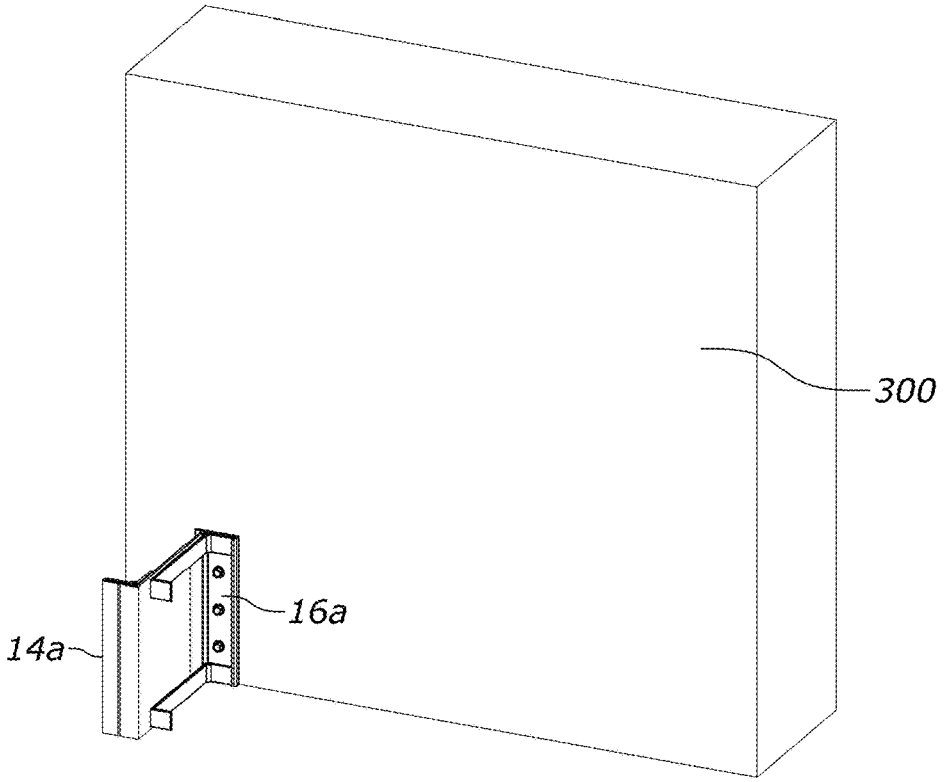
FIG. 14 of the drawings is a perspective view of an exemplary installation of the adjustable wall system of the present disclosure to form a wall.
Figure 15:
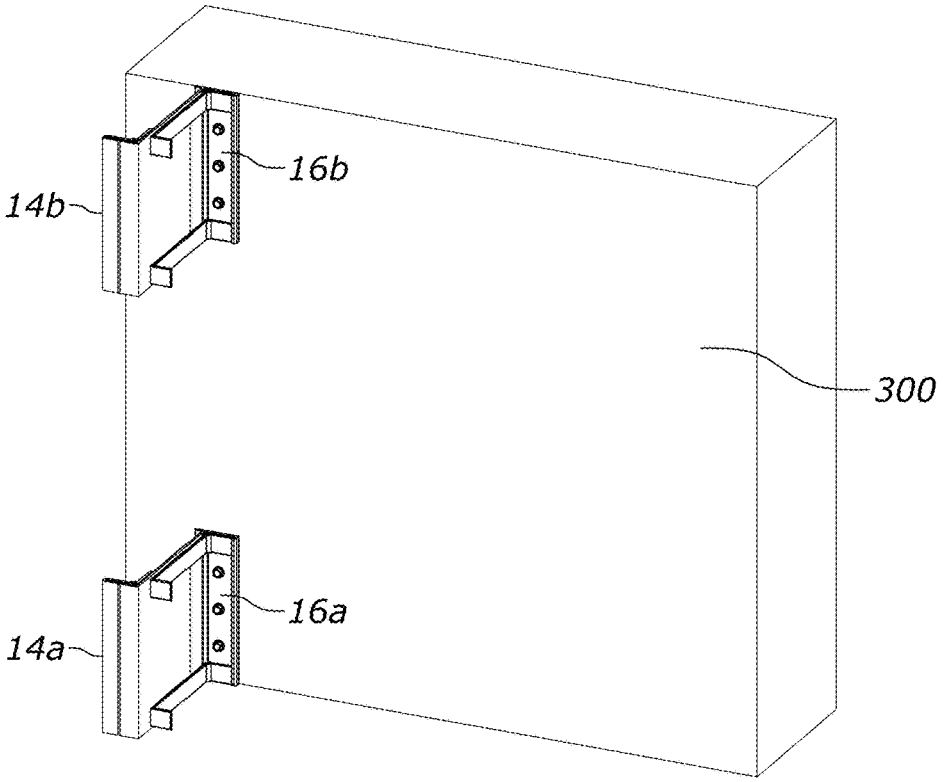
FIG. 15 of the drawings is a perspective view of an exemplary installation of the adjustable wall system of the present disclosure to form a wall.
Figure 16:
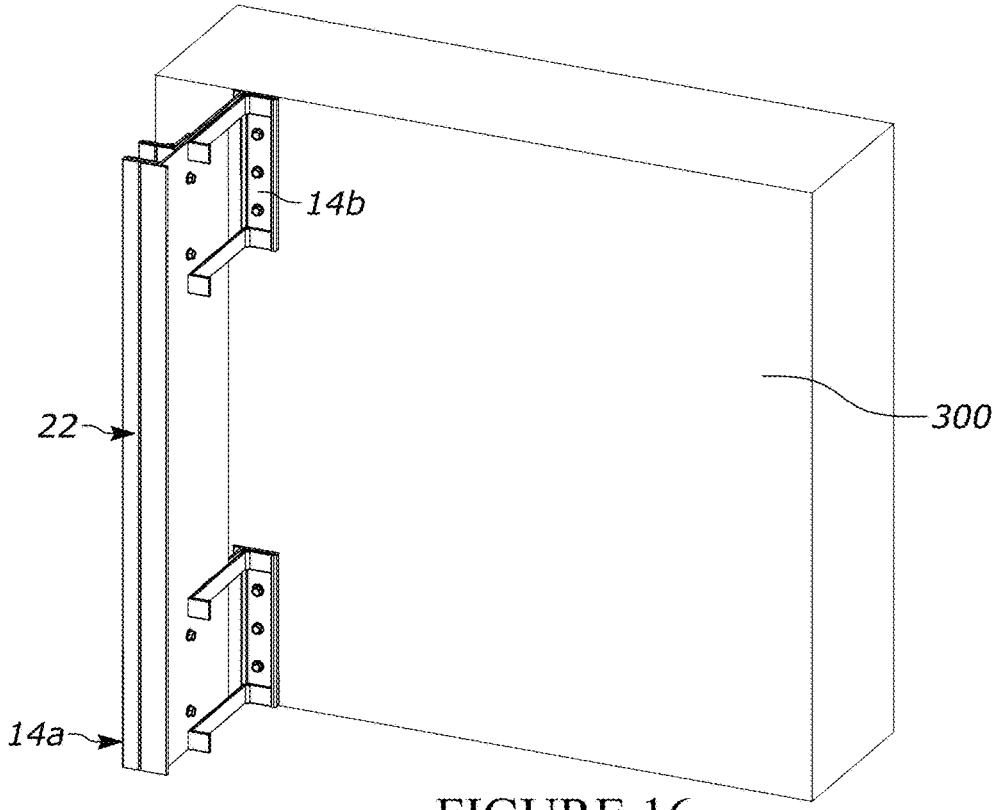
FIG. 16 of the drawings is a perspective view of an exemplary installation of the adjustable wall system of the present disclosure to form a wall.
Figure 17:
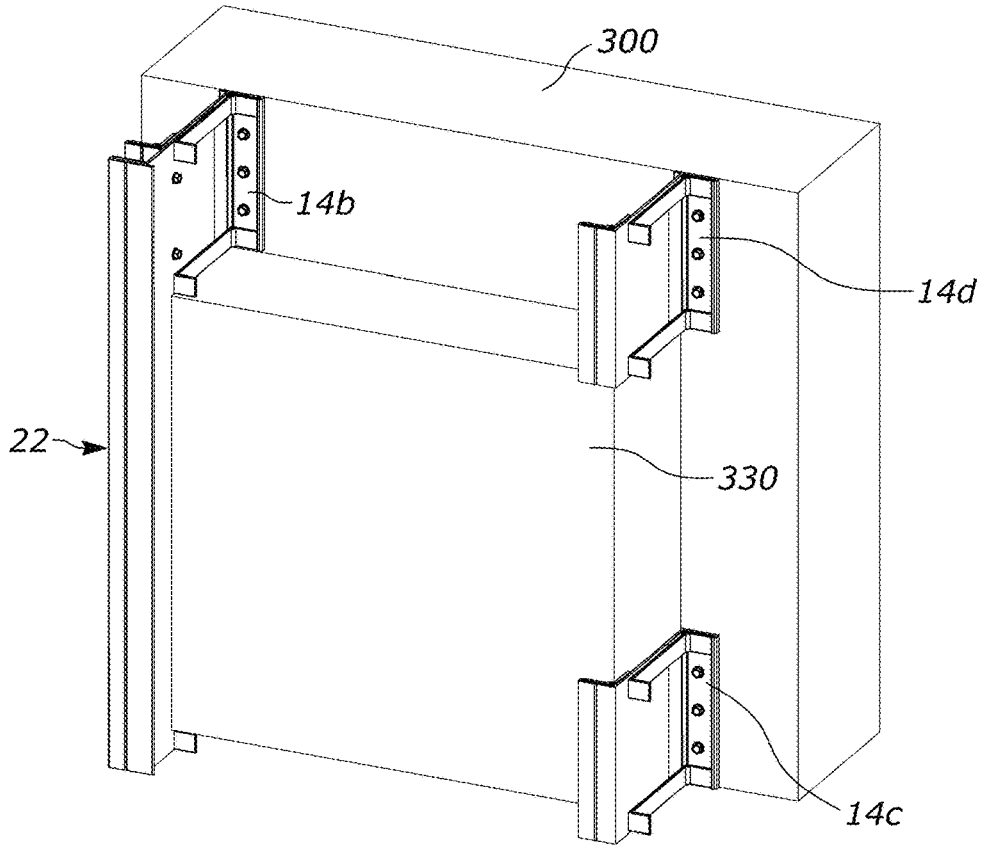
FIG. 17 of the drawings is a perspective view of an exemplary installation of the adjustable wall system of the present disclosure to form a wall.
Figure 18:
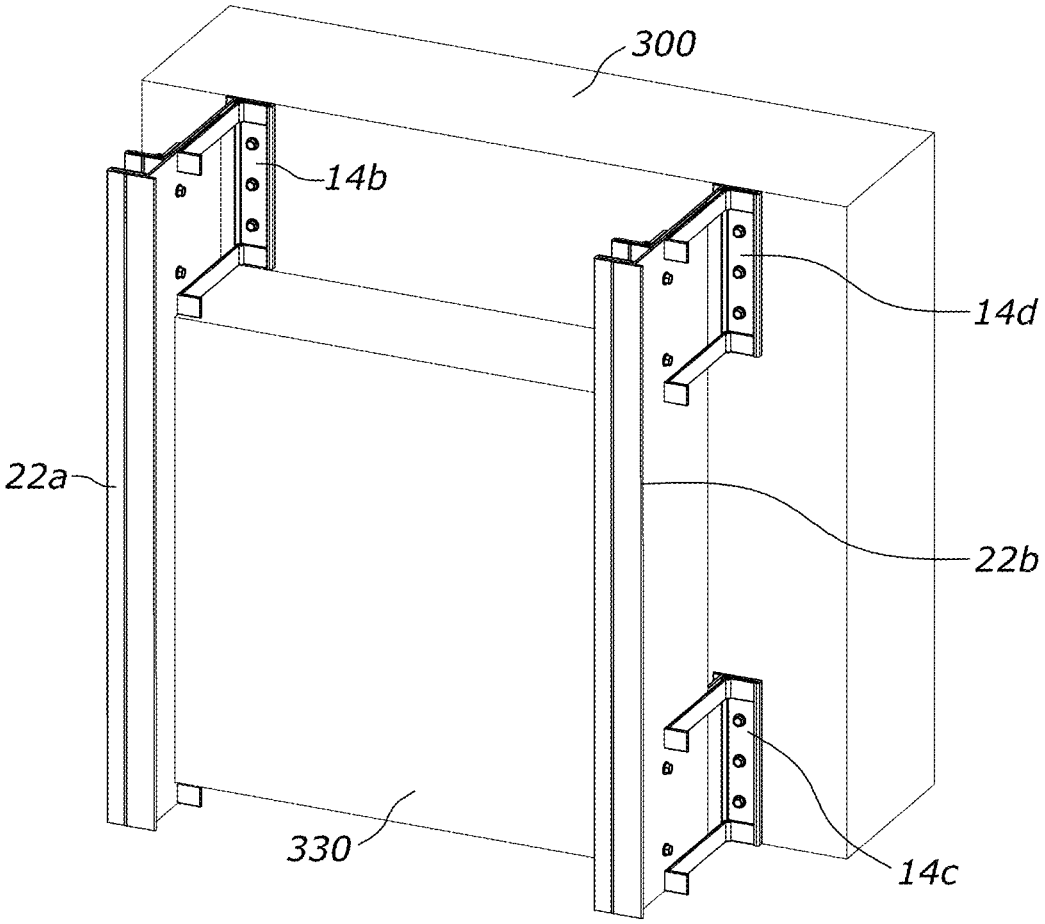
FIG. 18 of the drawings is a perspective view of an exemplary installation of the adjustable wall system of the present disclosure to form a wall.

The outer bracket 22 is shown in FIGS. 12 and 13 as comprising spanning wall 190 and outer end wall 204. It is contemplated that the outer wall comprises a polymer and fiber based composite that is pultruded or otherwise formed. In other configurations, it is contemplated that the outer bracket may comprise a metal member. In the instance of a metal member, the distal coupling member can be eliminated. Additionally, the channel 216 can be omitted in the outer end wall. In such a configuration, the metal member may comprise a single sheet material that includes a substantially right angle bend to form the spanning wall and the outer end wall.

The spanning wall 190 includes outer side 192 and inner side 194. The outer bracket is further defined by the upper edge 196, the lower edge 198, the inner surface 200 and the outer surface 202. The spanning wall 190 is substantially uniform in thickness and may comprise a substantially planar sheet like configuration. As explained above, and as will further be detailed below, the outer bracket may be larger than the base bracket member, and may span and be coupled to multiple base brackets.

The outer end wall includes outer surface 206 and inner surface 210. The outer surface my include outer longitudinal notch 208 (or other indicative structure) which provides a visual indication as to a location wherein fasteners can be extended. Other demarcations and the like are likewise contemplated. The outer end wall further includes a first leg region and a second leg region. The construction is similar to that of the first end wall 30 of the base bracket member 14, and the various different structures therein are disclosed with the outer end wall, as well as variations thereto. The second leg region 214 of the outer end wall 204 includes channel 216 that has first side slot 218, second side slot 220 opposite thereof, base 224 therebetween with central opening 222 opposite the base 224.

The distal coupling member, which is slidably positionable within the channel 216 includes an elongated member that has upper surface 230, lower surface 232, first end 234, second end 236, first slot edge 238, and second slot edge 240. As with the base mounting member, it is contemplated that the distal coupling member similarly comprises a single uniform member, with a substantially uniform cross-sectional configuration. Preferably, the distal coupling member (like the base mounting member) is formed of a metal member or an alloy thereof, while other materials are contemplated. Additionally, a number of different structures and configurations of mating engagement are contemplated. That is, in some configurations, the distal coupling member, like the base mounting member and, to some extent, the distal mounting member, a number of variations are contemplated with the manner of overlying attachment with the respective wall of the base bracket member and the outer bracket. In some configurations, the coupling member may be adhered to the outer end wall of the outer bracket, for example. In still other configurations, the two may be in overlying engagement and secured by fasteners that are configured to retain the cladding assembly. As will be understood with any such supporting members coupled to the base bracket member or to the outer bracket, the overlying engagement may rely on mechanical coupling, including but not limited to the structure disclosed, or a negative thereof, as well as to adhesive type coupling. In still further configurations, small fasteners, such as screws or bolts, or hook and loop type fasteners are contemplated for coupling these together. Advantageously, the mechanical coupling disclosed and many that are envisioned, facilitate retention thereof while forming openings and driving fasteners therethrough.

Figure 3:
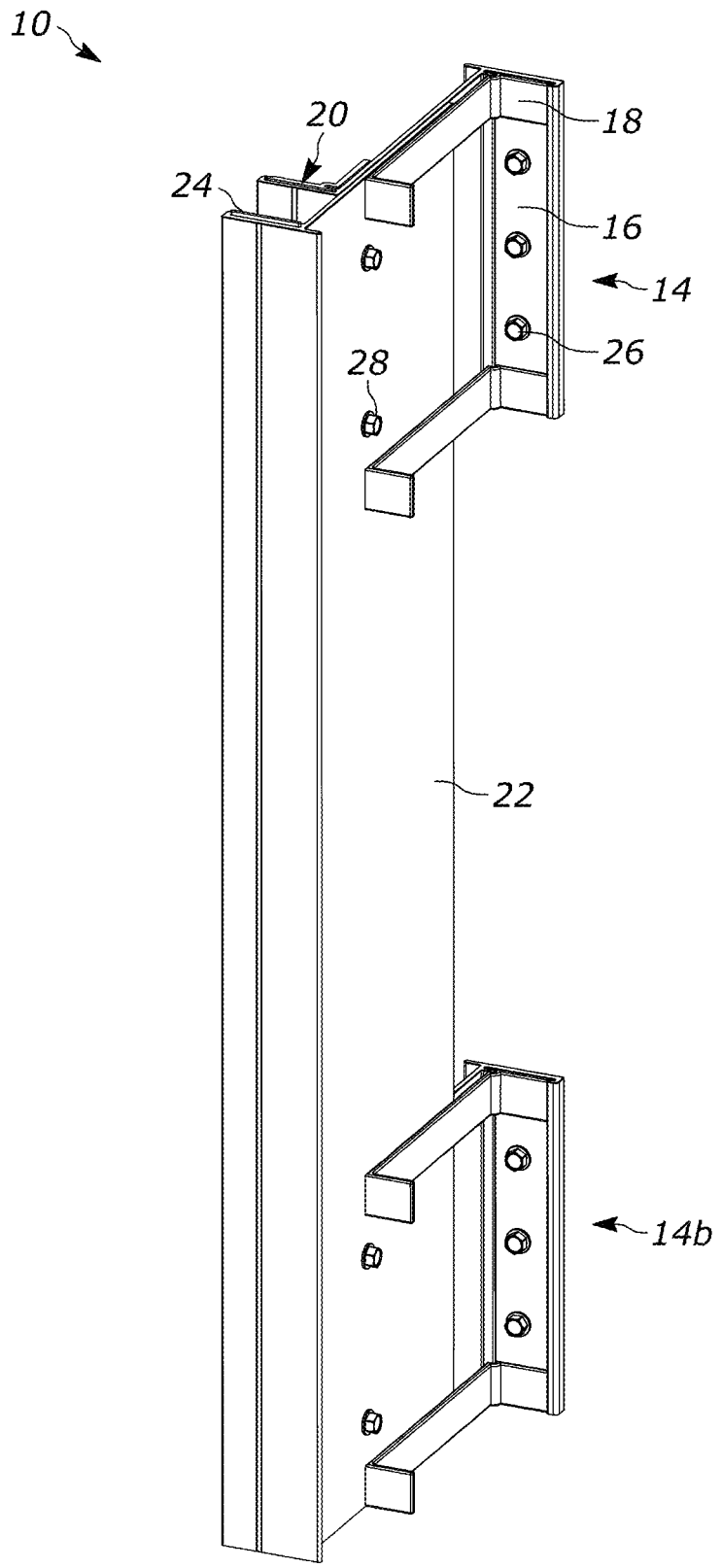
FIG. 3 of the drawings is a front perspective view of an adjustable support system of the present disclosure.
Figure 4:
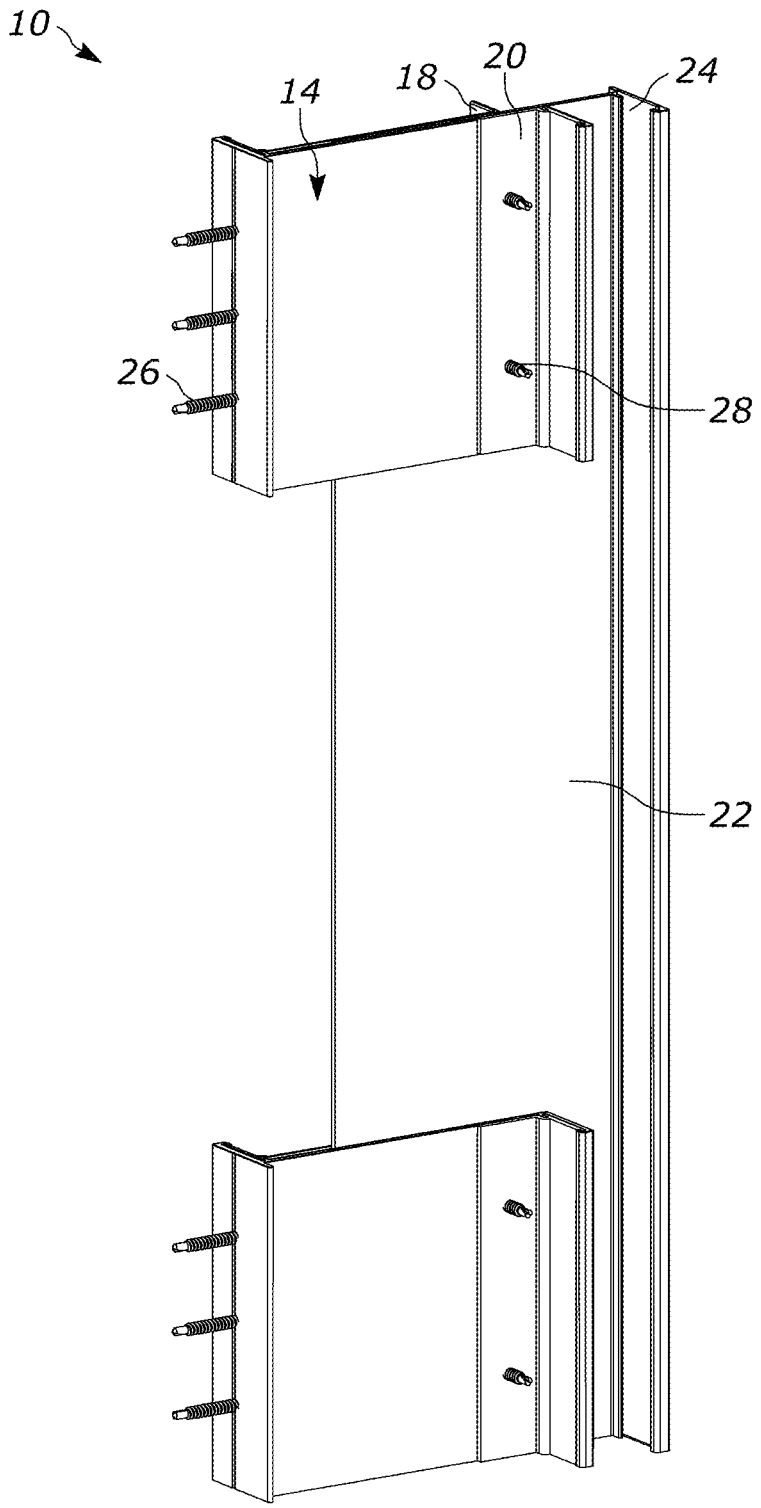
FIG. 4 of the drawings is a back perspective view of the adjustable support system of the present disclosure.

An exemplary wall assembly is shown in FIGS. 1 and 2. Such a configuration shows multiple fully assembled adjustable support systems in operation. One such assembled adjustable support system is shown in FIGS. 3 and 4. In the configuration shown, a pair of base bracket members 14*a* and 14*b* are assembled with the base mounting member 16, the clip members 18, and the distal mounting member 20 (to form a fully assembled base bracket system assembly) and positioned in a spaced apart configuration.

To assemble such a structure, a base bracket is provided. Once provided, the distal mounting member is slidably coupled to the second end wall 74 by slidably moving the distal slot engaging member into the channel 88 of the second end wall. Such a position places the support arm 162 into overlying abutment with the second side of the body wall 60.

A clip member is slidably coupled to the first end wall by slidably attaching the base bracket member coupling into the channel 46 of the first end wall. Once positioned, the base mounting member 16 is slid into the channel 46 of the first end wall 30. Finally, a second clip member 18 is slidably positioned within the channel in a similar manner as the first so as to sandwich the base mounting member between the two clip members.

With reference to FIGS. 14 through 18 and FIG. 1, the fully assembled base bracket members (and associated components) are coupled to a substrate. In particular, fasteners are extended through the base mounting members 16*a*, 16*b* and the first end walls 30*a*, 30*b* of the base bracket members 14*a*, 14*b* and into the substrate 300. The two brackets are generally spaced apart and generally positioned so that the base wall of each is coplanar.

Next, the outer bracket 22 is assembled by slidably positioning the distal coupling member into the channel of the outer end wall of the outer bracket. Once assembled, the outer bracket is coupled to each of the base bracket members 14*a*, 14*b*. In particular, the spanning wall is directed into the space between each of the clip members and the associated first sides of the body walls of the base bracket members. Due to the position of the clip members relative to the first side of the base and the spacing therebetween the clip members bias the outer bracket against the first side of the body wall so as to limit slidable movement therebetween (while allowing for repositioning with the application of some force). As such, the user can position the outer bracket between the clip members and the body wall, whereupon release the orientation is maintained by way of the biasing action of the clip member. It is contemplated that a light tack adhesive may be utilized to likewise maintain the position of the components, or, a high friction surface is likewise contemplated.

Advantageously, the position of the outer bracket can be modified relative to one of the two brackets to allow for compensation of flaws in the substrate. For example, whereas the substrate may be uneven or may be slightly oblique relative to a vertical surface, the outer bracket can be manipulated so that the distal coupling member is substantially vertical. This may also compensate for undulations in the substrate. It will be understood that the same adjustment can be repeated throughout a wall system such that undulations in a substrate outer surface nevertheless allows for a uniform outer cladding. As such, it will be understood that the outer end wall of the outer bracket may be oblique to the second end wall, due to the variation of the substrate and the desired position of the cladding. At the same time, the spanning wall of the outer bracket and the body wall of the base bracket member may be overlying each other and in parallel planes.

Once the outer bracket is positioned as desired, fasteners can be driven through the spanning wall of the outer bracket 22 into and through the base wall, and, eventually into the support arm positioned on the opposite side of the base wall from the spanning wall. This fastening can be repeated until one or multiple fasteners are extended through each of the body walls of each of the base bracket members.

This procedure can be repeated over and over again (i.e., 14*c*, 14*d*, 22*b*) until the full wall is formed. It is contemplated that a single outer bracket may interface with well in excess of two base bracket members. It is further contemplated that the outer brackets may be positioned in an end to end fashion with a base bracket member spanning between the outer bracket and the substrate at repeated intervals, such as, for example, between 6 inches and 24 inches. Of course, other configurations are likewise contemplated, as are other spans between different base bracket members.

Once fully installed, a cladding assembly may be coupled to the outer end wall through fasteners. For example, a cladding sheet may be attached directly to the outer end wall by directing fasteners through the outer end wall and through the distal coupling member, as is shown in FIG. 1.

In other configurations, such as the configuration of FIG. 2, horizontal rails, such as rails 330 may couple adjacent vertically oriented outer brackets. Subsequently, a cladding sheet may be coupled to the rails 330 so as to be indirectly coupled to the outer bracket. In such configurations, an outer bracket may be sized to correspond to a base bracket and there may be one to one correspondence of base bracket members to outer brackets. In such a configuration, the structure can come fully assembled, wherein the user merely has to utilize fasteners to fasten the bracket to the substrate and, upon adjustment of the outer bracket, the use can utilize fasteners to fix the outer bracket to the base bracket. Thus, the user is not required to assemble any structure at the jobsite. Of course, in other configurations, the user can be provided with the individual components for assembly at the job site.

Insulation may be positioned between adjacent rows of vertically spaced apart adjustable support systems. In such configurations, it is desirable that the distal flanges 124 of the clip members interface with the insulation to facilitate retention thereof, and to preclude relative movement of the insulation relative to the substrate, the cladding assembly and the adjustable support system.

With respect to dimensions, it is contemplated that the body wall may be, for example, between 3 and 6 inches in width, wherein the outer brackets can be adjustable from a first proximate position, wherein the distal coupling member and the second end wall substantially abut to a positioned wherein the two are spaced apart such that the spanning wall of the outer bracket and the body wall overlap a minimal amount (such as for example 1.5 inches or more or less). As such, wherein the base bracket member has a width of 6 inches, the total assembled width of the combination of the base bracket member and the outer bracket can be 10.5 inches, which allows for a 1.5 inch overlap. It is likewise contemplated that the projecting arm has a length which is 1.15 inches shorter than the width of the body wall so as to preferably preserve a spacing from the second end wall of the base bracket member. In other instances, the spanning wall may have a width that is greater than the body wall such that even in a collapsed configuration, the second end wall is spaced apart from the outer end wall of the outer bracket.

Figure 19:
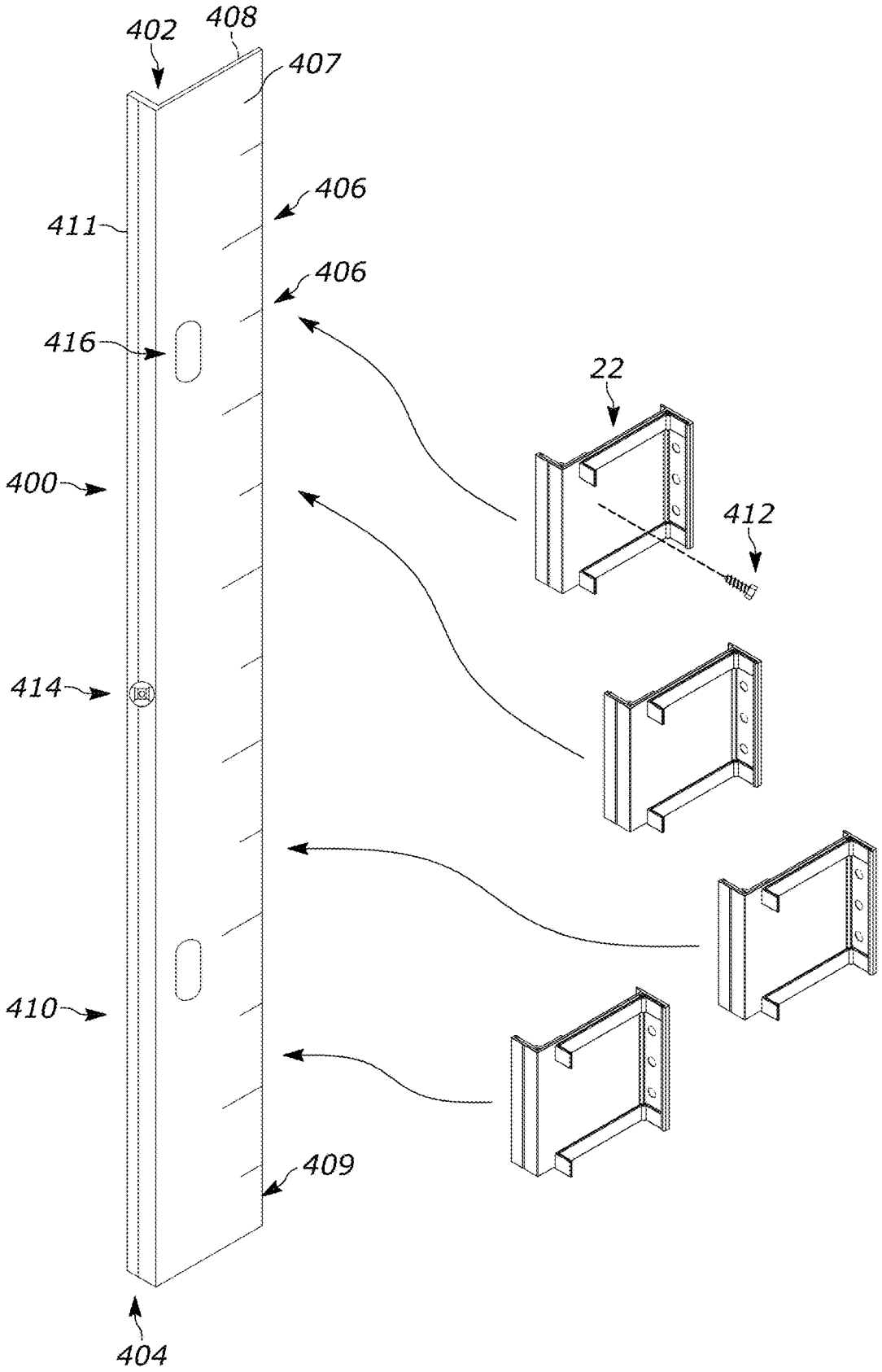
FIG. 19 of the drawings is a perspective view of a story pole having a plurality of bracket members (fully assembled) that are configured for releasable attachment thereto.
Figure 20:
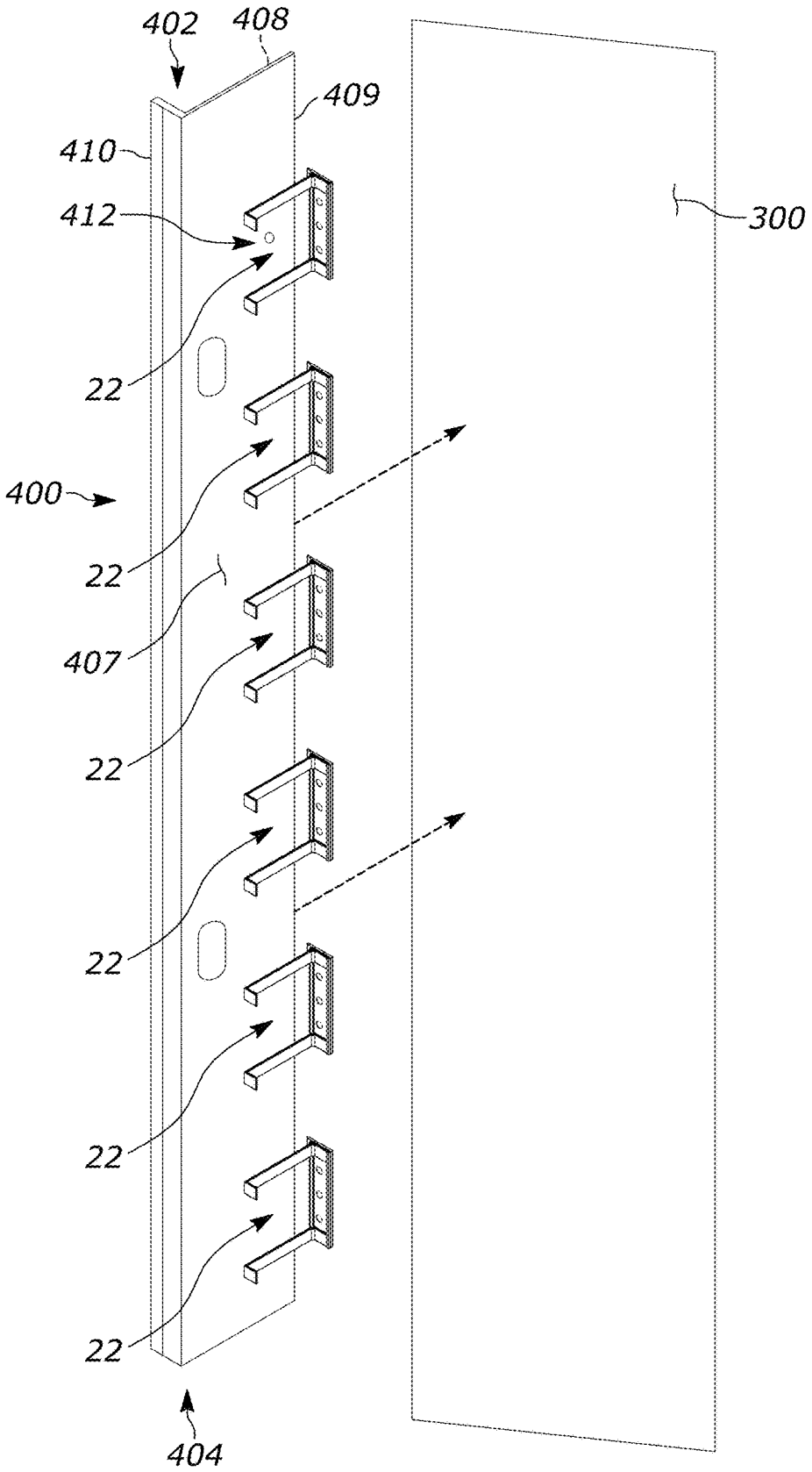
FIG. 20 of the drawings is a perspective view of a story pole having a plurality of bracket members (fully assembled) that are releasably attached thereto and ready for the positioning of the bracket members on to the surface of the building for attachment thereto.

In an alternate method of installing, and with reference to FIGS. 19 and 20, it is recognized that, for example, in the vertical orientation (while the same principles apply to the installation in the horizontal orientation) it may be difficult to align the fully assembled base brackets to receive the outer bracket 22. In such an instance, a story pole 400 can be utilized.

The story pole 400 comprises an elongated member having a length defined by first end 402 and a second end 404. The length of the story pole 400 is such that it is configured to span across multiple ones of the base brackets. In some configurations, the story pole 400 may vary in length from one foot to twelve or more feet, as well as any length therebetween. In other configurations, it may be more than twelve feet in length. It will be understood that in some variations, the story pole may be presented in a predetermined length, in other configurations, the story pole may be provided in a length and may be modified at an installation site, or prior to sending the story pole to the installation site.

In the configuration shown, an elongated outer bracket 22 can be utilized as the story pole 400. The story pole may include a first side 407 and a second side 408 opposite the first side. Additionally, an inner edge 409 and an outer edge 410 may be defined. The two edges oppose each other. It will be understood that the configuration of the story pole is such that it is configured to be engaged by bracket members in a spaced apart configuration. In the present configuration, the bracket sandwiches the story pole between structures, wherein the bracket provides a biasing force to maintain the releasable engagement. In other configurations, the story pole may exert a biasing force against the bracket so as to maintain the bracket in the releasable engagement. In one configuration, the story pole may comprise a wavy pattern that can be bent, and in turn, biased within a slot of a bracket. In other configurations, the story pole may have multiple components that sandwiches a portion of the bracket.

In the configuration shown, a flange 411 is presented at the outer edge of the story pole 400. This may be used as a handle, whereas the portion between the inner edge and the outer edge is substantially planar and oriented at a right angle relative to flange at the outer edge. In other configurations, the story pole may include flanges or grasping handles or openings, such as openings 416, along the first side and/or second side between the inner and outer edges. Furthermore, the inner edge and the outer edge may be parallel to each other and perpendicular to the first end and the second end, while, in other configurations, the surfaces may be oblique to each other, or undulating or irregular. Furthermore, the story pole between the inner edge and the outer edge is shown to be substantially while variations are contemplated.

Preferably, the story pole 400 has a plurality of demarcations 406 along one or both sides thereto. The demarcations may provide, for example, a guide as to placement of the different base brackets to achieve the desired spacing therebetween. In other configurations, the demarcations may provide a ruler or a standard of measure to likewise assist with placement of the base brackets. In still other configurations, the demarcations may include a plurality of different markings to achieve other spacing or desired placement of the base brackets. The demarcations may comprise adhesive appliques which are placed onto the base bracket or they may comprise physical markings that are formed into or on the surface of the story pole 400. In still other configurations, the demarcations may comprise markings that are printed, painted, sprayed, or otherwise applied to the outer surface. In other configurations, demarcations may extend on the first side and/or the second side and may include demarcations in multiple directions, that is relative distance in a first direction between the first and second end, or distance in a second direction between the inner edge and the outer edge. Further, it will be understood that in some configurations, demarcations may be fully omitted. In still other configurations, a level indicator 414 may be provided (i.e., one or a plurality of bubble type of level indicators, or a string and weight type of level indicator, among others) so as to facilitate determination of the orientation of the story pole relative to a horizontal or vertical orientation (or any other oblique desired orientation).

Figure 21:
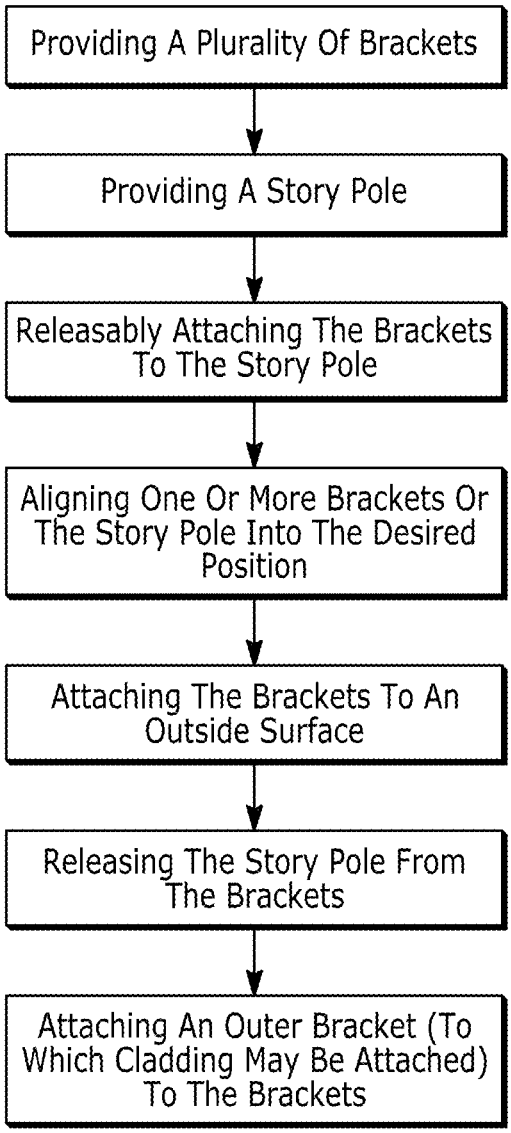
FIG. 21 is a flow chart of the method of installing a plurality of brackets.

With additional reference to FIG. 21, to utilize the story pole 400, the user is first provided the pole, along with one, or more likely a plurality of base brackets. Once provided, the user can releasably attach the base brackets to the story pole 400. In the configuration disclosed above, the story pole 400 is much like the outer bracket, and the base brackets can be attached by sliding the story pole 400 between the base bracket and the clip member. The base brackets can be spread along the story pole, and, where applicable, can be matched up with demarcations on the story pole. It will be understood that the base brackets sandwich the pole so that the brackets are releasably maintained in the placed orientation. Additionally, the orientation and position can be adjusted after initially set up. Other than setting up relative to the demarcations, it will be understood that the brackets may be moved toward or away from the first end, and/or toward or away from the inner edge, or both.

Next, once all of the desired brackets have been releasably coupled to the story pole, the story pole can be raised and directed to the building. In particular, the story pole is directed so that the base brackets can be directed onto the outer surface of the building (which may be the outer surface of the building itself, or another structure to which the base brackets are to be coupled).

The story pole can be manipulated to direct the base brackets into abutment with the outer surface of the building. And, they can be manipulated up and down (toward or away from the first end), left and right (toward or away from the inner edge), until they are in the correct position, or at least until a first one is in the correct position. At this point, preferably, the brackets are freely movable, but remain positioned once moved to a desired location and released. That is, force is required to alter the position of the base bracket, and once that force is removed, the biasing between the base bracket and the story pole retains the position of the base bracket relative to the pole.

As the story pole with the base brackets is positioned as desired, the user can attach the first of the base brackets to the outer surface of the building. The user can then sequentially attach any other base brackets in a desired order to the outer surface of the building. It will be understood that once the first base bracket is coupled, the remaining brackets are not coupled to the outer surface of the building, and they can be adjusted in position relative to the story pole, or the story pole can be adjusted relative to the first base bracket to properly orient a subsequent bracket. A second base bracket that is spaced apart from the first base bracket that is attached to the wall can then be adjusted into position and attached to the outer surface of the building. In many instances, the second base bracket may be the immediately adjacent bracket to the first base bracket that was attached, while, in many instances, the second base bracket to be attached is spaced apart from the first base bracket such that one or more brackets are positioned therebetween. It will be understood that the story pole with the remaining brackets remains retained by the first base bracket that was coupled to the outside surface of the building (i.e., the biasing between the first base bracket and the story pole is sufficient to keep the base bracket with the remaining brackets to be retained and precluded from inadvertent movement). In other instances, the user may temporarily (or permanently) couple the story pole to the first base bracket upon attachment thereof to the outside surface of the building with a fastener, such a screw 412, directed through the bracket and the story pole between the inner and outer edge thereof. That screw may be removed to remove the story pole.

The other base brackets can then be coupled to the outside surface of the building. Each base bracket can be adjusted in position relative to the story pole, while the story pole will insure alignment in one direction relative to other poles. So, while the poles will be aligned vertically (or horizontally), the individual brackets can be adjusted relative to the story pole in our out (i.e., toward or away from the building, and also and up and down (toward the base of the building or away from the base of the building in a vertical configuration), or, where the mounting is horizontal side to side (toward and away from either side of the building). The story pole ensures that the base brackets remain aligned in one of the dimensions set forth above despite variations in the outer surface of the building so that when the story pole is removed, an outer bracket can be utilized. Additionally and advantageously, due to variations in the outer surface of the building, the brackets may not be aligned in other orientations, but, nevertheless, the outer bracket can be coupled to each due to the alignment in the at least one direction. Additionally, it will be understood that the effective length of the outer bracket and the base brackets (due to the variations in the outer surface of the building, may vary, the outer bracket may nevertheless be oriented in a manner which is square, or which is uniform for attachment of cladding or the like. Thus, when the outer bracket is positioned in place of the story pole the alignment of the base brackets has been easily achieved and the outer bracket can easily be attached.

It will be understood that without the story board, the user may be faced with first setting chalk lines, and then spending substantial time aligning each base bracket with the chalk line or other reference, wherein each base bracket is individually positioned and aligned. On the other hand, with the story pole, a user can install a base bracket at one end of the story pole to the outer surface of the building, and then another that is distally spaced therefrom (i.e., two base brackets that are spaced apart from each other). Once those two are installed, the remaining base brackets therebetween can be installed with the assurance that the are aligned with the others, and will be able to receive an outer bracket.

Again, and as set forth above, the present method of utilizing the story pole can be applied to other brackets, and is not limited to the base bracket identified above. For example, any one of a number of base brackets that are attachable to discrete portions of an outer wall of a building, can be aligned utilizing the present method. For example, such a system can be utilized with the brackets of Nvelope, available from NVELOPE of Herts, United Kingdom; brackets of the Stoventro, available from Sto Corp, of Atlanta, Georgia; the Cascadia Clip brackets available from Cascadia windows and doors, of Langley, Canada; the brackets of ISOCLIP available from www.isoclips.com; or the bracket from CL-TALON of North Bergen, New Jersey. It will be understood that due to the configuration of some of these brackets, it may not be possible to achieve all of the benefits of the configuration shown above.

Once the base brackets are installed, the story pole may be disconnected from the base brackets. Other base brackets (i.e., another row or column) can be installed in the same manner. An outer bracket can then be attached, adjusted and secured to the base brackets.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A method of installing a plurality of brackets comprising the steps of:

providing the plurality of brackets;

providing a story pole, wherein the story pole has a first end and a second end;

releasably attaching the plurality of brackets to the story pole, including the step of sandwiching the story pole between portions of at least one of the plurality of brackets and maintaining attachment through a biasing force exerted between the bracket and the story pole;

positioning the story pole having the plurality of brackets proximate an outside surface to which the plurality of brackets is to be attached;

attaching a first one of the plurality of brackets to the outside surface in a desired orientation;

attaching a second one of the plurality of brackets in a desired orientation;

attaching at least a plurality of remaining ones of the plurality of brackets to the outside surface; and releasing the story pole from the plurality of brackets that are attached to the outside surface, leaving the plurality of brackets attached to the outside surface in alignment in at least one dimension.

2. The method of claim 1 further comprising the step of:

suspending the story pole and the remaining ones of the plurality of brackets from the first one of the plurality of brackets after the step of attaching the first one of the plurality of brackets to the outside surface.

3. The method of claim 1 further including the step of moving at least one of the plurality of brackets after the step of attaching the first one of the plurality of brackets to the outside surface.

4. The method of claim 3 further including the step of moving at least a plurality of the plurality of brackets after the step of attaching the first one of the plurality of brackets to the outside surface.

5. The method of claim 1 wherein the biasing force is such that a user can apply a moving force that overcomes the biasing force to allow for adjustment of the orientation of the at least one of the plurality of brackets upon which the biasing force is exerted, whereupon release of such moving force precludes further movement of the at least one of the plurality of brackets due at least the biasing force.

6. The method of claim 1 wherein the at least one of the plurality of brackets is retained in a desired orientation solely by the biasing force.

7. The method of claim 1 further comprising the step of second releasably attaching the story pole to the first one of the plurality of brackets with a fastener.

8. The method of claim 7 further comprising the step of removing the fastener prior to the step of releasing.

9. The method of claim 1 wherein the story pole further includes at least one demarcation thereon, and the method further includes the step of aligning at least one of the plurality of brackets based upon the at least one demarcation.

10. The method of claim 1 further comprising the step of:

aligning the story pole and the first one of the plurality of brackets into a desired orientation relative to the outside surface prior to the step of attaching the first one of the plurality of brackets.

11. A method of installing a plurality of brackets comprising the steps of:

providing the plurality of brackets;

providing a story pole, wherein the story pole has a first end and a second end;

releasably attaching the plurality of brackets to the story pole;

positioning the story pole having the plurality of brackets proximate an outside surface to which the plurality of brackets is to be attached;

attaching a first one of the plurality of brackets to the outside surface in a desired orientation;

attaching a second one of the plurality of brackets in a desired orientation;

attaching at least a plurality of remaining ones of the plurality of brackets to the outside surface;

releasing the story pole from the plurality of brackets that are attached to the outside surface, leaving the plurality of brackets attached to the outside surface in alignment in at least one dimension; and attaching an outer bracket to a plurality of the plurality of brackets after the step of attaching the brackets to the outside surface after the step of releasing the story pole.

12. A method of installing a plurality of brackets comprising the steps of:

providing the plurality of brackets;

providing a story pole, wherein the story pole has a first end and a second end, and defines an inner edge and an outer edge opposite the inner edge, wherein the story pole further includes at least one of a flange positioned at one of the outer edge and between the outer edge and the inner edge, and, an opening disposed between the first end and the second end;

releasably attaching the plurality of brackets to the story pole;

positioning the story pole having the plurality of brackets proximate an outside surface to which the plurality of brackets is to be attached;

attaching a first one of the plurality of brackets to the outside surface in a desired orientation;

attaching a second one of the plurality of brackets in a desired orientation; and releasing the story pole from the plurality of brackets that are attached to the outside surface, leaving the plurality of brackets attached to the outside surface in alignment in at least one dimension.

13. The method of claim 12, wherein the plurality of brackets comprises at least three brackets, and the method further comprises the step of:

attaching at least a plurality of the remining ones of the plurality of brackets to the outside surface.

14. The method of claim 12 wherein the story pole further includes a first side and a second side opposite the first side, with at least one of a demarcation and a level indicator disposed on at least one of the first side and the second side.

15. A system comprising:

an outer bracket;

a plurality of base brackets configured to be attachable to an outside surface, with the outer bracket being attachable to the plurality of base brackets in a spaced apart configuration;

a story pole, releasably attachable to the plurality of base brackets, the story pole attachable to the base brackets for alignment with and attachment to the outer surface, whereupon the story pole is released prior to the attachment of the outer bracket to the plurality of base brackets.

16. The system of claim 15 wherein the story pole further includes at least one of a demarcation disposed thereon and a level indicator.

17. The system of claim 15 wherein the story pole includes a first portion having an inner edge that is interfaceable with the plurality of base brackets, and an outer edge opposite the inner edge, and further including at least one of an opening and a flange extending from the first portion between at least one of at the outer end and between the inner end and the outer end.

* * * * *